US011740041B2

(12) United States Patent
Vanek

(10) Patent No.: US 11,740,041 B2
(45) Date of Patent: Aug. 29, 2023

(54) BUFFER TUBES

(71) Applicant: Vantac Technologies LLC, Florence, MT (US)

(72) Inventor: Joede Thomas Vanek, Florence, MT (US)

(73) Assignee: Vantac Technologies LLC, Darby, MT (US)

( * ) Notice: Subject to any disclaimer, the term of this patent is extended or adjusted under 35 U.S.C. 154(b) by 0 days.

(21) Appl. No.: 17/806,553

(22) Filed: Jun. 13, 2022

(65) Prior Publication Data

US 2022/0397357 A1 Dec. 15, 2022

Related U.S. Application Data

(60) Provisional application No. 63/209,913, filed on Jun. 11, 2021.

(51) Int. Cl.
*F41A 3/84* (2006.01)

(52) U.S. Cl.
CPC ..... *F41A 3/84* (2013.01)

(58) Field of Classification Search
CPC ..... F41C 23/14; F41C 23/04; F41C 23/20; F41C 23/06
See application file for complete search history.

(56) References Cited

U.S. PATENT DOCUMENTS 3,442,042 A 5/1969 Gilbert
4,327,626 A * 5/1982 McQueen ..... F41A 3/54 89/197
6,839,998 B1 1/2005 Armstrong
7,793,453 B1 9/2010 Sewell, Jr. et al.
7,984,580 B1 7/2011 Giauque et al.
8,991,088 B1 3/2015 Young
9,347,736 B2 5/2016 Huang et al.
9,612,083 B2 4/2017 Cottle et al.
9,746,281 B2 8/2017 Wilson et al.
(Continued)

OTHER PUBLICATIONS

Patent Cooperation Treaty, International Search Report and Written Opinion, of the United States Patent Office, issued in corresponding International Patent Application No. PCT/US2022/033212, dated Feb. 17, 2023.

(Continued)

*Primary Examiner* — Joshua E Freeman
(74) *Attorney, Agent, or Firm* — Locke Lord LLP; Daniel J. Fiorello

(57) ABSTRACT

A buffer tube for a firearm can include a body defining an interior cavity for receiving a buffer spring, and a rail disposed on and/or formed from the outer surface of the body. The rail can include one or more pin holes configured to receive a pin of a stock to lock the stock in a position, and a trunk opening defined at an end of the rail forming a first rail sidewall and second rail sidewall configured to receive a trunk of an actuator. The first and/or second rail sidewalls can include a slot defined therethrough configured to receive a pin associated with the trunk of the actuator to linearly guide the actuator. The rail can include a slide bar channel defined through at least a portion of the rail and configured to allow a slide bar to slide therein relative to the one or more pin holes to urge a pin out of a respective pin hole and/or to block a pin from being received by the pin holes.

15 Claims, 23 Drawing Sheets

(56) References Cited

U.S. PATENT DOCUMENTS

| | | | | |
|---|---|---|---|---|
| 10,054,394 | B2 | 8/2018 | Jen et al. | |
| 10,260,837 | B1 * | 4/2019 | McGinty | F41A 3/84 |
| 10,451,380 | B2 | 10/2019 | Vanek et al. | |
| 10,527,385 | B1 * | 1/2020 | Schumacher | F41C 23/14 |
| 10,928,159 | B2 | 2/2021 | Vanek et al. | |
| 10,989,236 | B2 | 4/2021 | Cross | |
| 11,262,158 | B2 | 3/2022 | Cahill | |
| 2003/0101631 | A1 | 6/2003 | Fitzpatrick et al. | |
| 2010/0205846 | A1 | 8/2010 | Fitzpatrick et al. | |
| 2011/0283584 | A1 * | 11/2011 | Walters | F41C 23/14 42/73 |
| 2012/0180353 | A1 * | 7/2012 | Holmberg | F41C 23/06 42/1.06 |
| 2014/0259848 | A1 | 9/2014 | Chvala | |
| 2016/0069636 | A1 | 3/2016 | Gomirato et al. | |
| 2016/0187099 | A1 | 6/2016 | Cottle et al. | |
| 2016/0327361 | A1 | 11/2016 | Roberts et al. | |
| 2017/0205190 | A1 | 7/2017 | Jen et al. | |
| 2017/0356718 | A1 * | 12/2017 | Johnson | F41C 23/20 |
| 2018/0003459 | A1 | 1/2018 | Miller et al. | |
| 2018/0066916 | A1 * | 3/2018 | Olsen | F41C 23/14 |
| 2018/0176944 | A1 | 6/2018 | Wang et al. | |
| 2018/0347939 | A1 * | 12/2018 | Keller | F41C 23/04 |
| 2019/0017774 | A1 | 1/2019 | Vanek et al. | |
| 2019/0195595 | A1 | 6/2019 | Kielsmeier et al. | |
| 2019/0204043 | A1 | 7/2019 | Vanek et al. | |
| 2020/0200505 | A1 | 6/2020 | Brown, Jr. | |
| 2020/0400403 | A1 * | 12/2020 | Vanek | F41C 23/14 |
| 2021/0199404 | A1 | 7/2021 | Vanek et al. | |

OTHER PUBLICATIONS

Vantac Nation, "Welcome to the Future D.A.D.S (Direct Access Defense System)", FaceBook, May 25, 2021 (retrieved on Dec. 8, 2022) Retrieve from the Internet: <URL:https://www.facebook.com/vantacinternational/videos/3786496171459361> entire video.

* cited by examiner

100
G
119
101
111
105
117
107
107
141
105
G
100

100

101
111
105
SECTION G-G 107
117
107
111b
111c
111a
100
115
100

119
111
141
105
101

Section I-I

BUFFER TUBES

CROSS-REFERENCE TO RELATED APPLICATIONS

This application claims priority to and the benefit of U.S. Provisional Application No. 63/209,913, filed Jun. 11, 2021, the entire contents of which are herein incorporated by reference in their entirety.

BACKGROUND

1. Field

This disclosure relates to firearms, more specifically to buffer tubes for firearms.

2. Description of Related Art

Existing buffer tube systems are inert metal tubes with an interior spring to work the rifle bolt. Such conventional methods and systems have generally been considered satisfactory for their intended purpose. However, there is still a need in the art for improved buffer tubes. The present disclosure provides a solution for this need.

SUMMARY

In accordance with at least one aspect of this disclosure, a buffer tube for a firearm can include a body defining an interior cavity for receiving a buffer spring, and a rail disposed on and/or formed from the outer surface of the body. The rail can include one or more pin holes configured to receive a pin of a stock to lock the stock in a position, and a trunk opening defined at an end of the rail forming a first rail sidewall and second rail sidewall configured to receive a trunk of an actuator. The first and/or second rail sidewalls can include a slot defined therethrough configured to receive a pin associated with the trunk of the actuator to linearly guide the actuator. The rail can include a slide bar channel defined through at least a portion of the rail and configured to allow a slide bar to slide therein relative to the one or more pin holes to urge a pin out of a respective pin hole and/or to block a pin from being received by the pin holes.

In accordance with at least one aspect of this disclosure, a buffer tube assembly can include a buffer tube for a firearm having a body defining, an interior cavity for receiving a buffer spring, and a rail disposed on and/or formed from the outer surface of the body. The rail can include one or more pin holes configured to receive a pin of a stock to lock the stock in a position, and a trunk opening defined at an end of the rail forming a first rail sidewall and second rail sidewall. The first and/or second rail sidewall can include a slot defined therethrough. A slide bar channel can be defined through at least a portion of the rail. The assembly can include a slide bar disposed in the slide bar channel to slide therein relative to the one or more pin holes to urge a pin out of a respective pin hole and/or to block a pin from being received by the pin holes in an actuated position, and to allow a pin to enter the one or more pin holes in an unactuated position. The assembly can include an actuator connected to the slide bar to pull the slide bar. The actuator can include a trunk slidably disposed within the trunk opening in the rail between the first and second rail sidewalls, and a slide pin extending laterally from the trunk of the actuator and configured to be inserted into the slot to engage the slot to linearly guide the actuator.

In certain embodiments, the slide pin can extend from a single side of the trunk. In certain embodiments, the actuator can be pinned to the slide bar and configured to rotate relative to the slide bar when the slide pin is disengaged from the slot.

In certain embodiments, the slide pin can be biased to extend laterally outward to engage the slot. For example, the slide pin can be depressible to allow the slide pin to be removed from the slot for removal of the actuator from the rail.

The actuator can be pinned to the slide bar and configured to rotate relative to the slide bar when the slide pin is disengaged from the slot, and to pull the slide bar. In certain embodiments, in an engaged position where the pin is engaged in the slot, the actuator can extend underneath a connection end of the body (e.g., to a position that is reachable by a thumb of a user without removing a user's hand from a firing position) and can be configured to be linearly actuated (e.g., by a user's thumb of their firing hand without removing the hand from a grip). In a disengaged and folded position, the actuator can extend further rearward to be further away from the connection end of the body to aid installation of the body onto a firearm. For example, in the disengaged and folded position, the actuator can extend away (e.g., downward) from the body and the connection end of the body.

The assembly can include a biasing member configured to bias the slide bar and/or the actuator to the unactuated position. In certain embodiments, the biasing member can be disposed at a rear end of the slide bar. The biasing member can be trapped between a fastener attached to a rear of slide bar and an inner surface of the rail such that when the slide bar is actuated toward the actuated position, the biasing member is compressed between the fastener and the inner surface of the rail. In certain embodiments, the actuator can be attached to a front end of the slide bar. In certain embodiments, the slide bar can be confined to linear sliding motion within the rail.

In accordance with at least one aspect of this disclosure, a method can include attaching a connection end of a body of a buffer tube assembly onto a firearm, and folding an actuator attached to the buffer tube assembly to engage a pin of the actuator to a rail to constrain the motion of the actuator to be linear, and preventing removal of the connection end due to a position of the actuator. The method can include disengaging the pin of the actuator, and folding the actuator away from the body of the buffer tube to allow installation or removal of the buffer tube assembly.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figures 1A, 1B, 1C, 1D, 1E:
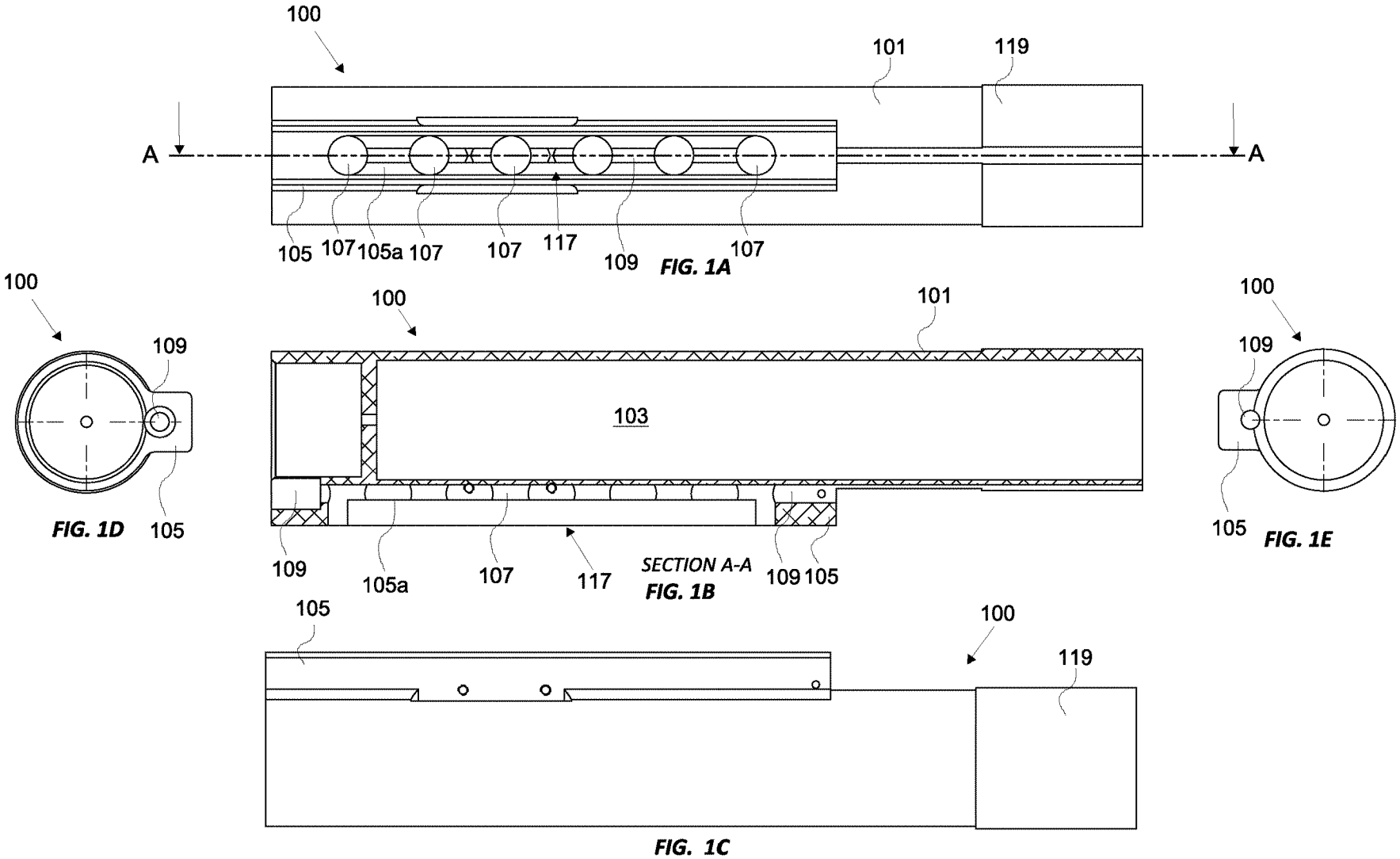
FIG. 1A is a plan view of an embodiment of a buffer tube in accordance with this disclosure.
FIG. 1B is a cross-sectional view of the embodiment of FIG. 1A along line A-A in a direction into the page.
FIG. 1C is a side elevation view of the embodiment of FIG. 1A.
FIG. 1D is a rear elevation view of the embodiment of FIG. 1A.
FIG. 1E is a front elevation view of the embodiment of FIG. 1A.

Reference will now be made to the drawings wherein like reference numerals identify similar structural features or aspects of the subject disclosure. For purposes of explanation and illustration, and not limitation, an illustrative view of an embodiment of a buffer tube in accordance with the disclosure is shown in FIG. 1A and is designated generally by reference character 100. Other embodiments and/or aspects of this disclosure are shown in FIGS. 1B-10C.

Referring to FIGS. 1A-1E, a buffer tube 100 for a firearm can include a body 101 defining an interior cavity 103 for receiving a buffer spring (not shown). The buffer tube 100 can include a rail 105 disposed on and/or formed from the outer surface of the body 101. The rail 105 can include one or more pin holes 107 (e.g., six as shown) configured to receive a pin (e.g., as shown in FIG. 2C) of a stock (e.g., as shown in FIGS. 2A-2M) to lock the stock in a position. The buffer tube 100 can also include a slide bar channel 109 defined through at least a portion of the rail 105.

Referring additionally to FIGS. 1F-1M, the slide bar channel 109 can be configured to allow a slide bar 111 to slide therein relative to the one or more pin holes 107 to urge a pin out of a respective pin hole 107 and/or to block a pin 107 from being received by the pin holes 107. The slide bar channel 109 can include any suitable shape and/or size, and can extend through an entire length of the rail 105, for example.

The rail 105 can extend radially outward from the body 101, for example. The one or more pin holes 107 can include a plurality of pin holes 107 (e.g., six as shown) defined in a radial direction (e.g., relative to a centerline axis of the body 101) in the rail 105. Any suitable number of pin holes 107 is contemplated herein (e.g., corresponding to any suitable number of discrete positions of a stock).

The slide bar channel 109 can open at an outward face 105*a* of the rail at least along a portion of an axial length (e.g., along a direction of axis A-A) thereof such that the slide bar channel 109 connects a plurality (e.g., all) of the pin holes 107. In certain embodiments, the slide bar channel 109 can open at the outward face 105*a* of the rail 105 at least between a first pin hole 107 (e.g., the furthest right in FIG. 1A) and a last pin hole 107 (e.g., the furthest left in FIG. 1A) such that the slide bar channel 109 connects all of the pin holes 107.

Figures 1F, 1G, 1H, 1I, 1J:
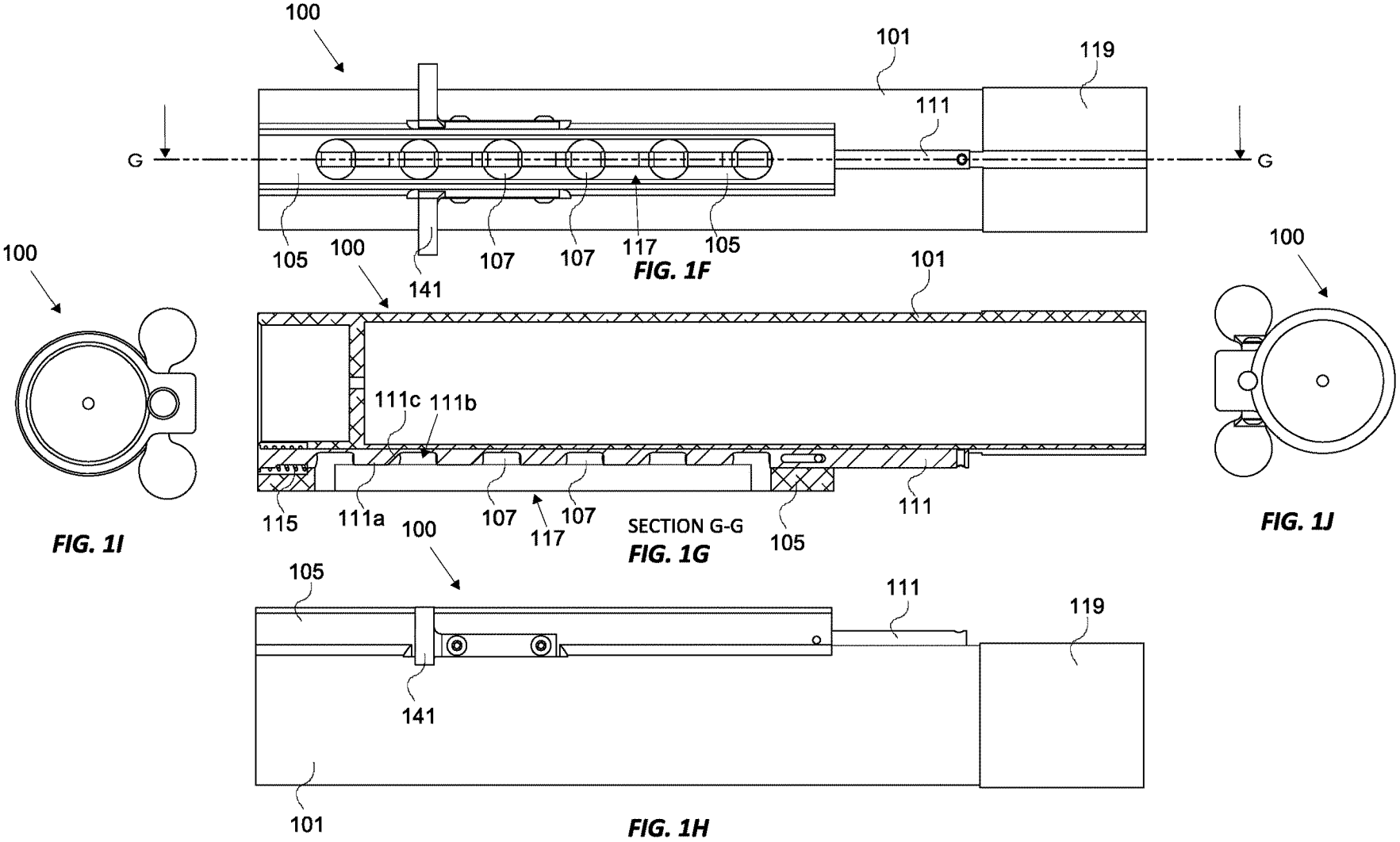
FIG. 1F is a plan view of the embodiment of a buffer tube of FIG. 1, shown including an embodiment of a slide bar slidably disposed in a rail of the buffer tube in accordance with this disclosure, and also shown include an embodiment of a spring stop assembly mounted to the rail in accordance with this disclosure, wherein the slide bar is in a first position in accordance with this disclosure.
FIG. 1G is a cross-sectional view of the embodiment of FIG. 1F along line G-G into the page.
FIG. 1H is a side elevation view of the embodiment of FIG. 1F.
FIG. 1I is a rear elevation view of the embodiment of FIG. 1F.
FIG. 1J is a front elevation view of the embodiment of FIG. 1F.
Figures 1K, 1L, 1M:
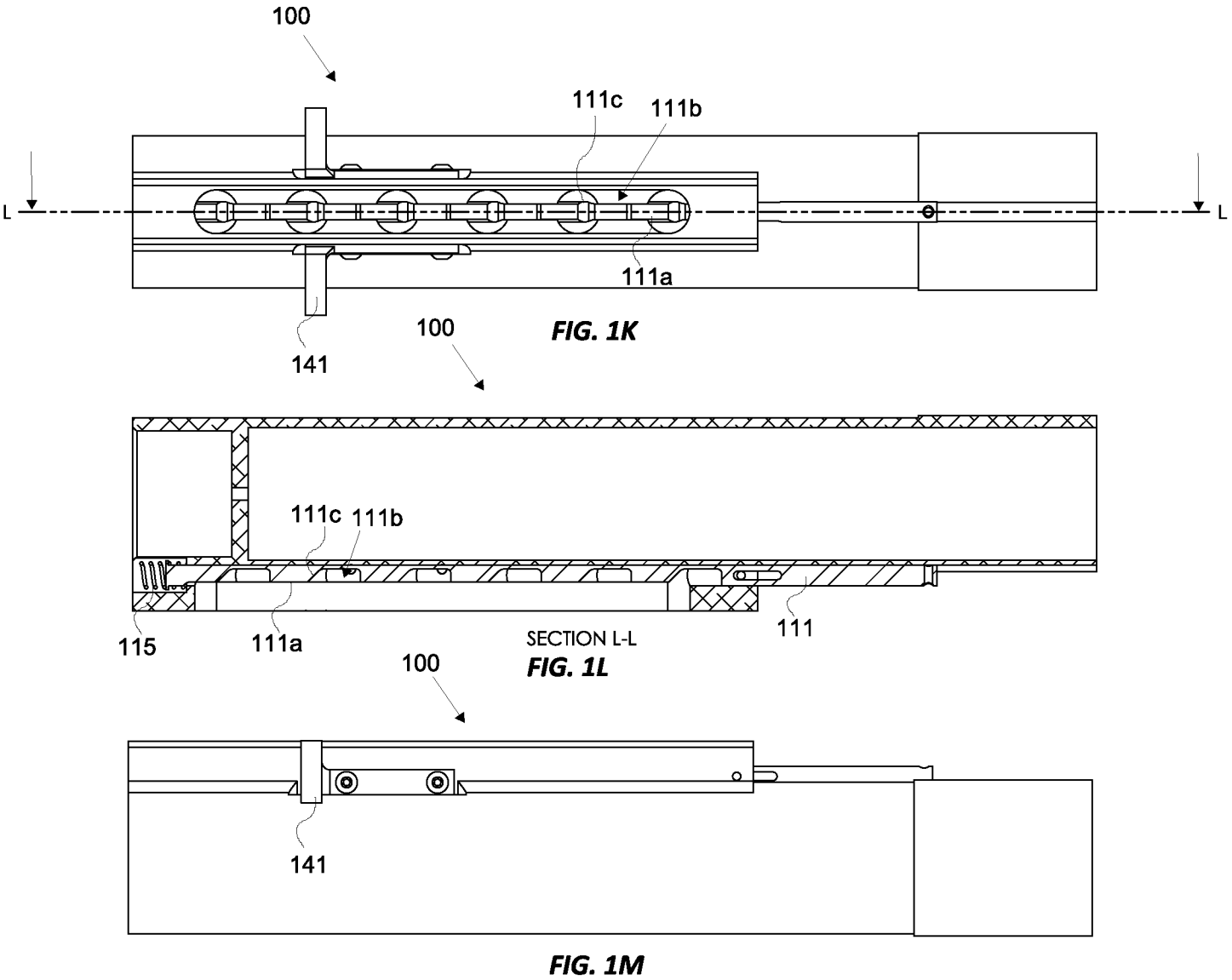
FIG. 1K is a plan view of the embodiment of a buffer tube of FIG. 1, shown including an embodiment of a slide bar slidably disposed in a rail of the buffer tube in accordance with this disclosure, and also shown include an embodiment of a spring stop assembly mounted to the rail in accordance with this disclosure, wherein the slide bar is in a second position in accordance with this disclosure.
FIG. 1L is a cross-sectional view of the embodiment of FIG. 1F along line L-L into the page.
FIG. 1M is a side elevation view of the embodiment of FIG. 1F.

In certain embodiments, the buffer tube 100 can include the slide bar 111, e.g., as shown in FIGS. 1F-1M disposed within the slide bar channel 109 and configured to slide relative to the rail 105. The slide bar 111 can be configured to allow a pin (e.g., pin 113 as shown in FIG. 2C) to enter into the one or more pin holes 107 in a first position (e.g., as shown in FIGS. 1F-1J). The slide bar 111 can be configured to urge a pin (e.g., 113) out of the one or more pin holes 107 and/or to block a pin (e.g., 113) from entering the one or more pin holes 107 when moved from the first position (as shown in FIGS. 1F-1J) toward a second position (e.g., as shown in FIGS. 1K-1M).

In certain embodiments, the slide bar 111 can include one or more teeth 111*a* that define one or more pin pockets 111*b* to receive a pin (e.g., 113) therein to allow a pin (e.g., 113) to enter into the one or more pin holes 107 when the slide bar 111 is in the first position (e.g., as shown in FIGS. 1F-1J and FIGS. 2C and 2D). As shown, in certain embodiments, the one or more teeth 111*a* can include a plurality of teeth 111*a* defining a pin pocket 111*b* for each of the one or more pin holes 107, for example. The one or more teeth 111*a* can include a ramp face 111*c* such that when the slide bar 111 is moved in a direction (e.g., toward the second position as shown in FIGS. 1K-1M) that causes a pin (e.g., 113) and the ramp face 111*c* to contact, the ramp face 111*c* urges the pin (e.g., 113) radially outward of the respective pin hole 107 (e.g., as shown in FIGS. 2G and 2H).

In certain embodiments, the buffer tube 100 can include a slide bar biasing member 115 (e.g., a coiled spring as shown) disposed between the slide bar 111 and the rail 105 and/or the body 101 to bias the slide bar to the first position (e.g., as shown in FIG. 1G). The slide bar biasing member 115 can be configured to fit within a portion of the slide bar channel 109 (e.g., a rear portion thereof as shown). In certain embodiments, e.g., as shown, the slide bar 111 can include an extension portion (e.g., a larger diameter portion, e.g., a flange) at an end thereof to capture the slide bar biasing member 115 within the slide bar channel 109 between the slide bar 111 can the rail 105 and/or the body 101. Any suitable biasing member, position, and/or number thereof are contemplated herein.

In certain embodiments, the rail 105 can include a trough 117 defined therein. The one or more pin holes 107 can be disposed within the trough 117, e.g., as shown. The trough 117 can be configured to limit a position of the pin (e.g., 113) of the stock, e.g., as shown in FIG. 2C (e.g., forward limit) and 2J (e.g., rearward limit).

The body 101 can include any suitable shape (e.g., tubular, having a circular or other suitable cross-sectional shape). The body 101 can include any other suitable features (e.g., threads 119), as appreciated by those having ordinary skill in the art.

Figure 2A:
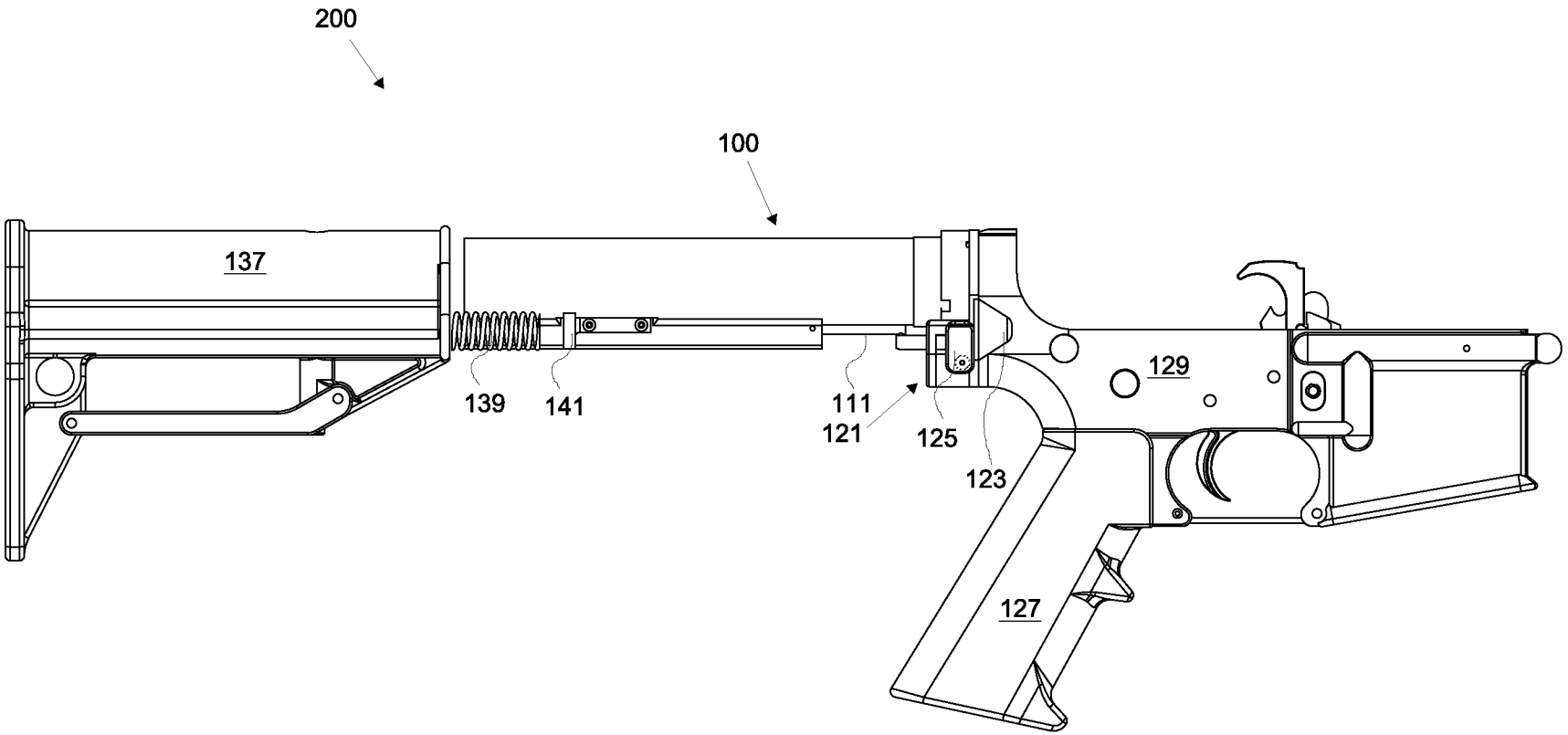
FIG. 2A is a side elevation view of an embodiment of a stock system in accordance with this disclosure, shown mounted to an embodiment of a lower receiver of a firearm and shown partially exploded.
Figure 2B:
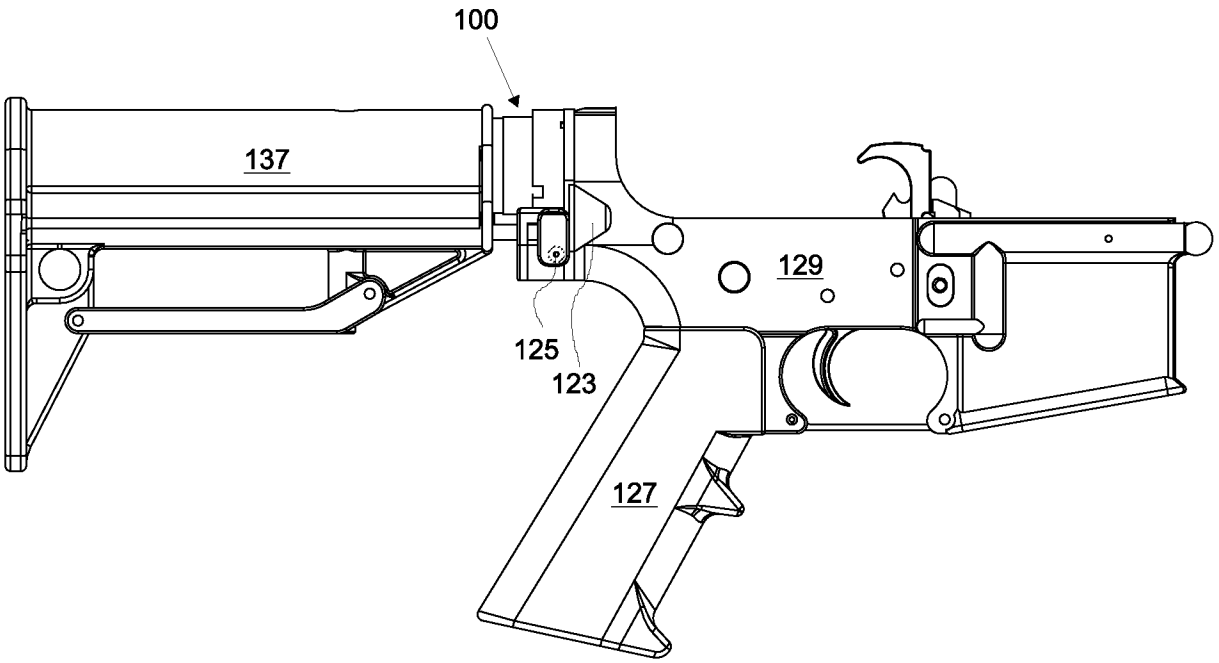
FIG. 2B is a side elevation view of the embodiment system of FIG. 2A, showing an embodiment of a stock of the stock system in a collapsed position and shown having the actuator in an unactuated position.
Figure 2D:
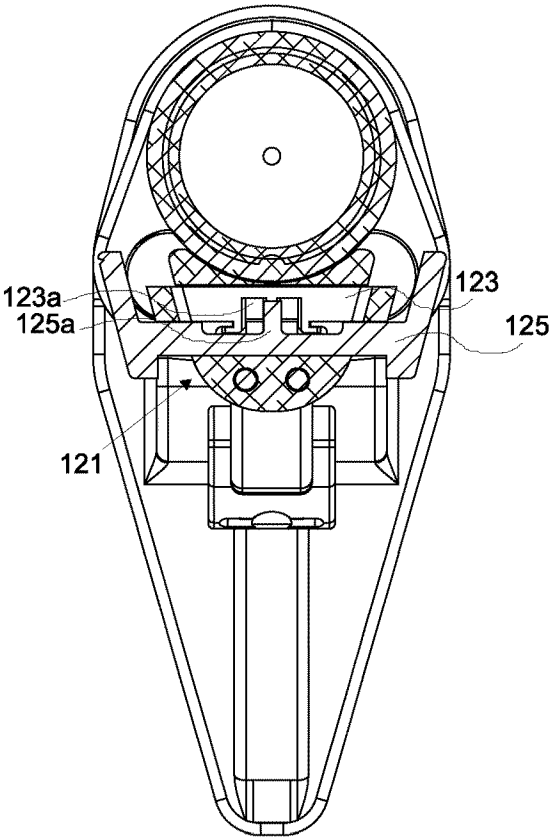
FIG. 2D is a cross-sectional view of an embodiment of FIG. 2D, showing an embodiment of a blocking member in a blocking position preventing an embodiment of an actuator from moving.
Figure 2C:
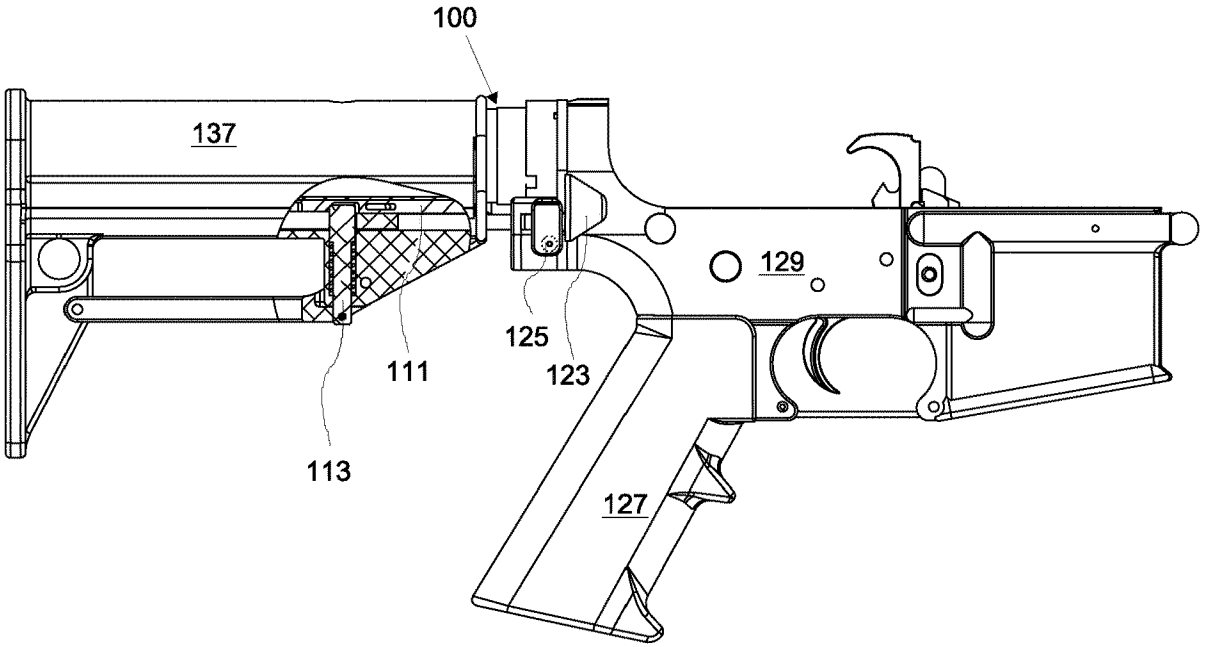
FIG. 2C is a side elevation view of the embodiment system of FIG. 2B, showing a partial cross-sectional view and illustrating a locked position of the pin.
Figure 2F:
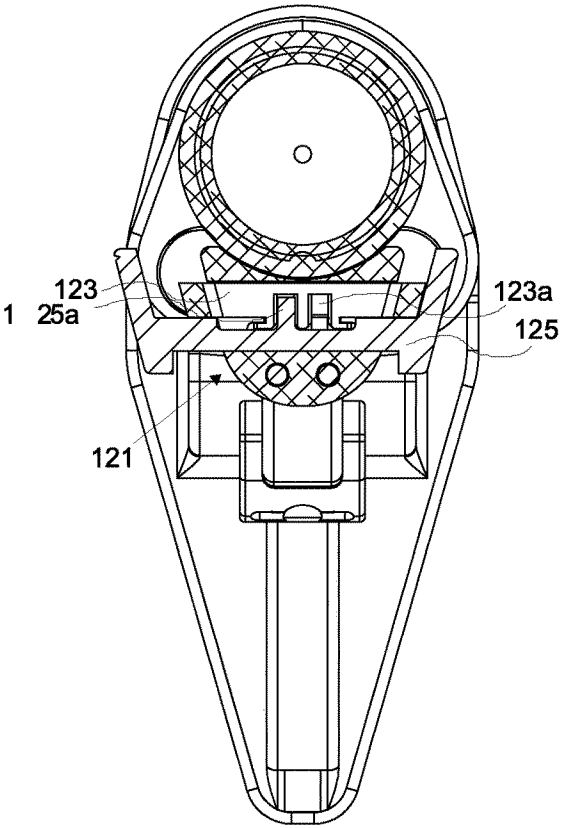
FIG. 2F is a cross-sectional view of an embodiment of FIG. 2D, showing the blocking member in an unblocking position allowing the actuator to move forward.
Figure 2E:
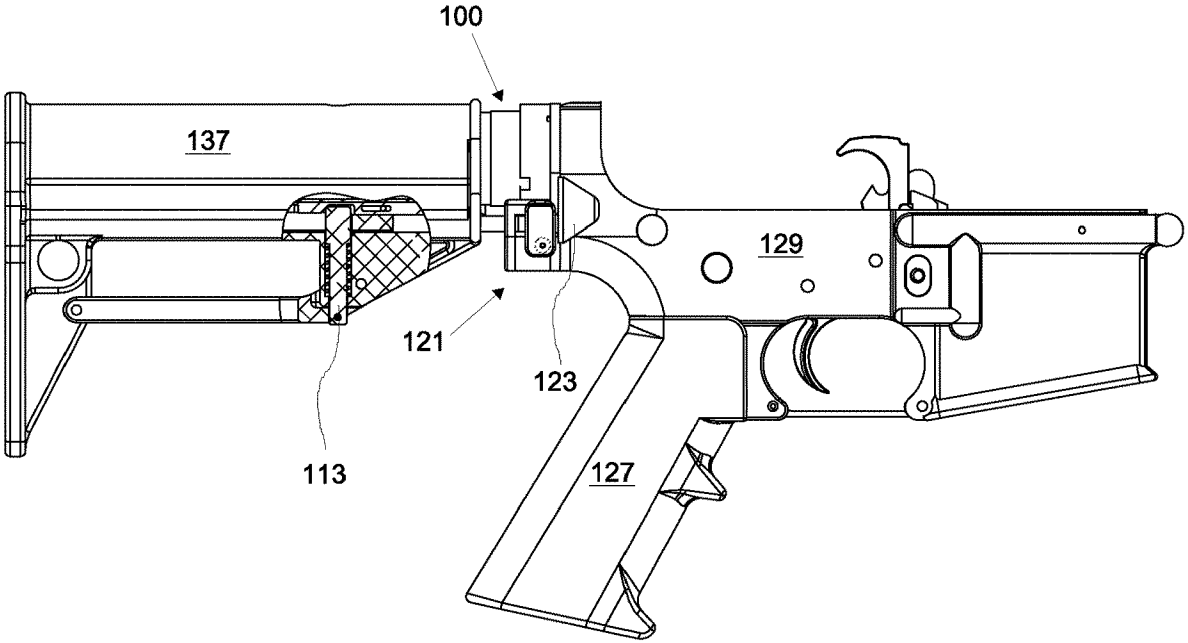
FIG. 2E is a side elevation view of the embodiment system of FIG. 2D, showing the blocking member moved to an unblocking position.
Figure 2G:
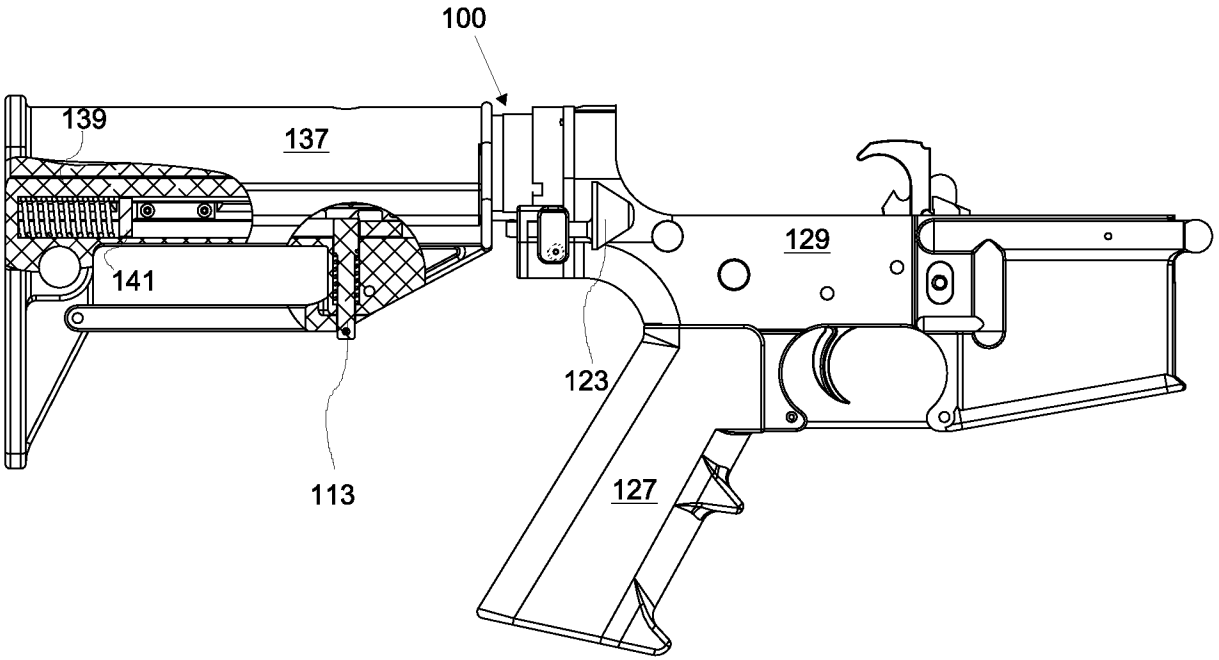
FIG. 2G is a side elevation view of the embodiment system of FIG. 2F, shown having the actuator in an actuated position, thereby moving the slide bar to the second position and the pin to the unlocked position, and showing a partial cross-sectional view illustrating an unlocked position of the pin and an embodiment of a spring assembly biasing the stock to an extended position.
Figure 2H:
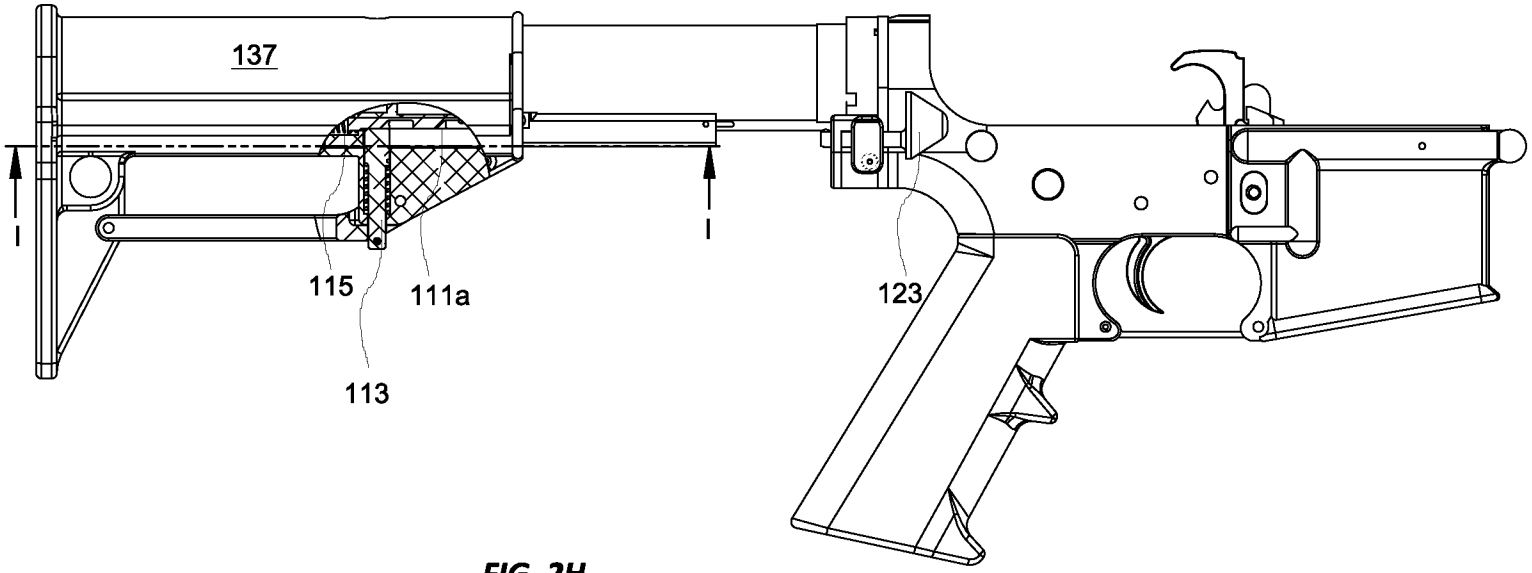
FIG. 2H is a side elevation view of the embodiment system of FIG. 2G, shown having the actuator in an actuated position and the stock moved to a fully extended position such that the pin contacts an aft end of a trough of a rail.
Figure 2I:
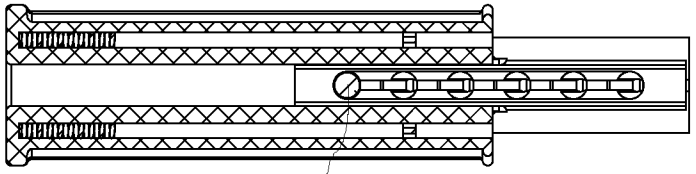
FIG. 2I is a cross-sectional plan view of the embodiment as shown in FIG. 2H, taken through line I-I.
Figure 2J:
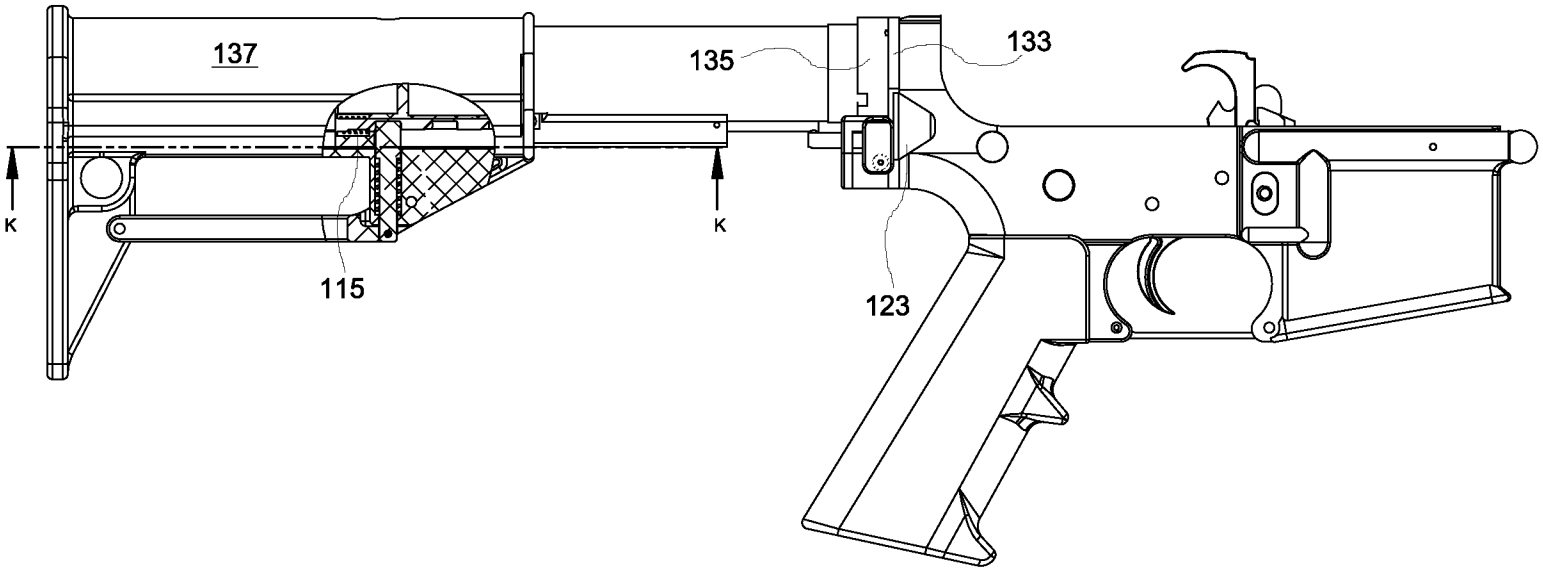
FIG. 2J is a side elevation view of the embodiment system of FIG. 2H, shown having the actuator in an unactuated position such that the slide bar is in the first position and such that the pin is in a locked position in accordance with this disclosure.
Figure 2K:
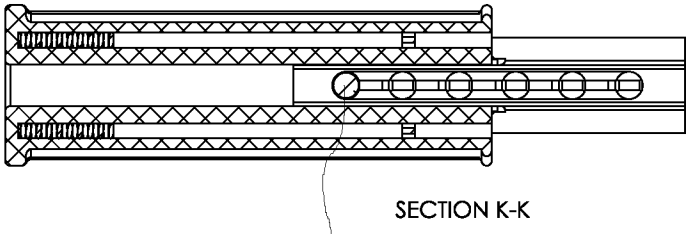
FIG. 2K is a cross-sectional plan view of the embodiment as shown in FIG. 2I, taken through line K-K.
Figure 2L:
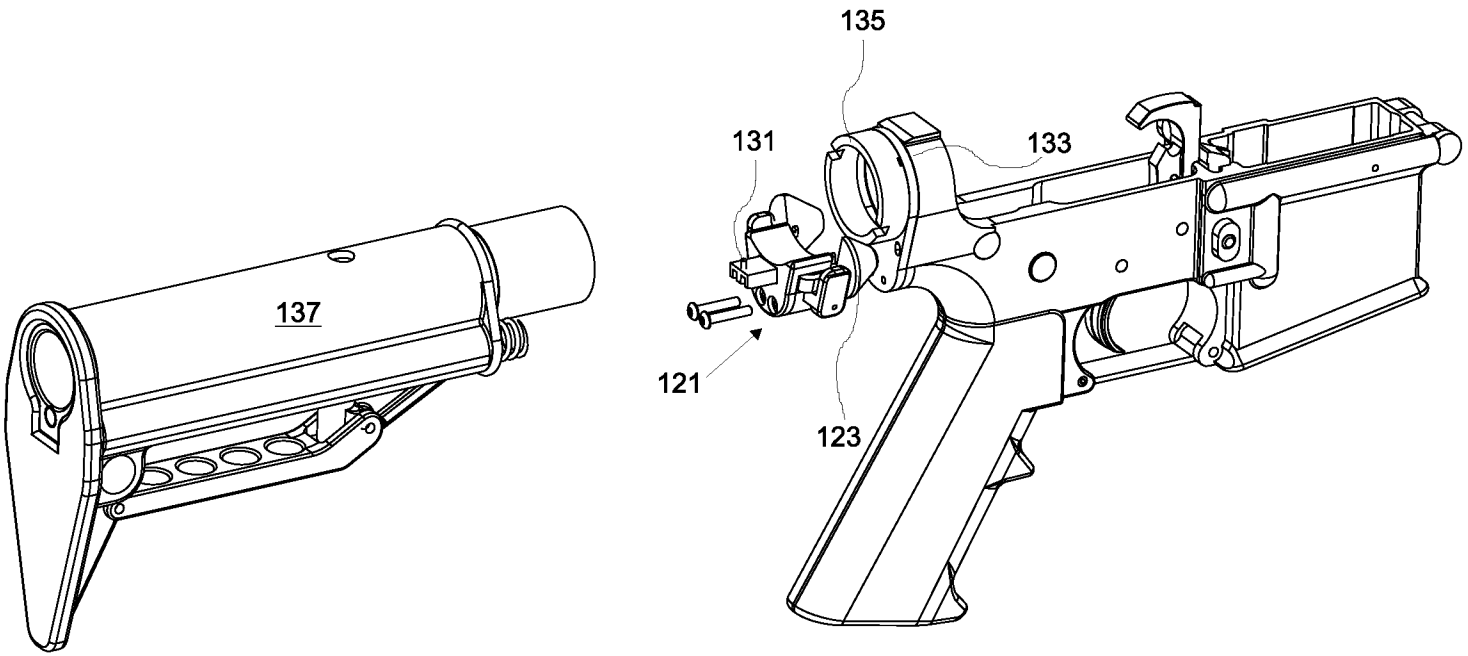
FIG. 2L is a partial isometric view of the embodiment of FIG. 2A, showing an embodiment of an actuator assembly exploded from the lower receiver and in isolation from the buffer tube.
Figure 2N:
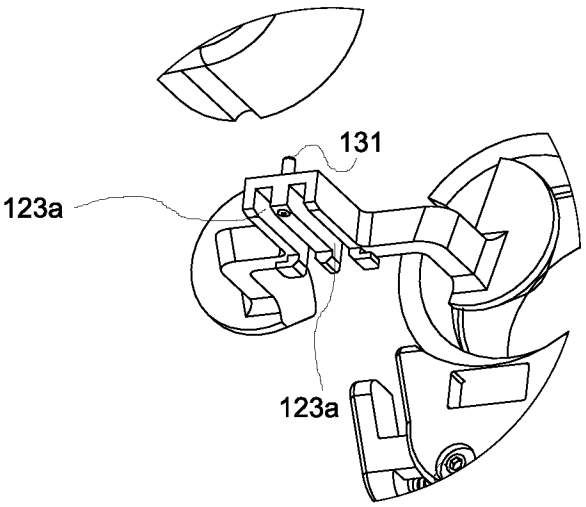
FIG. 2N is a close up view of the embodiment as shown in FIG. 2M.
Figure 2M:
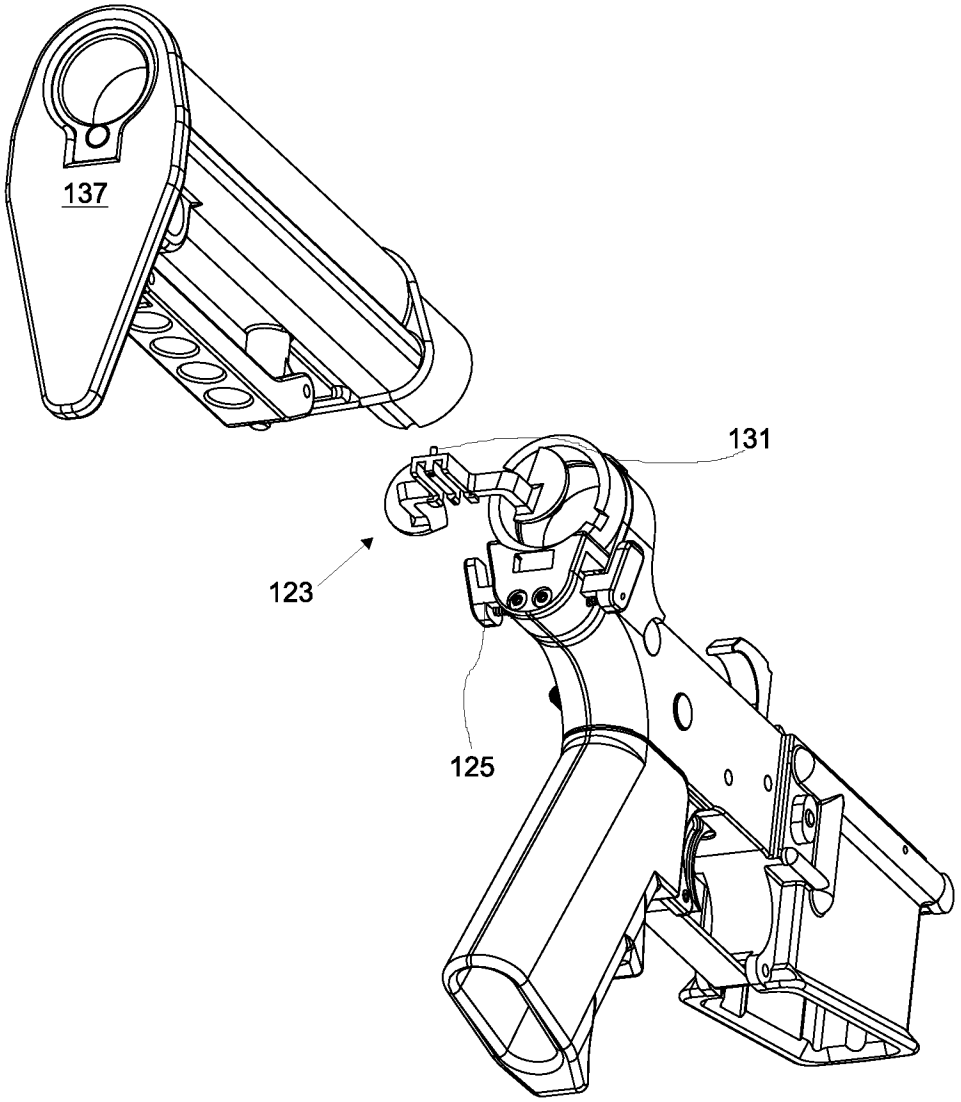
FIG. 2M is a partial isometric view of the embodiment as shown in FIG. 2L, showing an embodiment of an actuator in isolation from the actuator assembly.

In accordance with at least one aspect of this disclosure, referring additionally to FIGS. 2A-2N, a stock system 200 for a firearm (e.g., an AR-15 type or any other suitable firearm) can include any suitable embodiment of a buffer tube disclosed herein, e.g., buffer tube 100 as described above. The stock system 200 can include any suitable embodiment of a slide bar disclosed herein, e.g., slide bar 111 as described above, disposed within the slide bar channel 109 and configured to slide relative to the rail 105.

The system 200 can include an actuator assembly 121 having an actuator 123 operatively connectable or connected to the slide bar 111 to allow a user to move the slide bar 111 from the first position to the second position by moving the actuator 123 from an unactuated position (e.g., as shown in FIG. 2A) to an actuated position (e.g., as shown in FIG. 2G) when connected to the slide bar 111. The actuator 123 can be connected to the slide bar 111 in any suitable manner (e.g., integrally formed together, latched together, brazed together, screwed together, etc.). The system 200 can include a slide bar biasing member 115 disposed between the slide bar 111 and the rail 105 and/or the body 101 to bias the slide bar 111 toward the first position and thus biasing the actuator 123 toward an unactuated position.

In certain embodiments, the actuator assembly 121 can include a blocking member 125 configured to be moved between a blocking position (e.g., as shown in FIG. 2D) such that the actuator 123 is not moveable toward the actuated position and an unblocking position (e.g., as shown in FIG. 2F) such that the actuator 123 is moveable to the actuated position. The actuator assembly 121 can include a block biasing member (e.g., one or more springs) configured to bias the blocking member 125 to the blocking position (e.g., centered as shown).

In certain embodiments, e.g., as shown, the actuator 123 and the blocking member 125 can be configured to be accessible and actuatable from both sides of a grip 127 (e.g., a pistol grip shown attached to a lower receiver 129) of the firearm such that the actuator assembly 121 is usable by a right handed user or a left handed user. In certain embodiments, the actuator 123 and the blocking member 125 can be actuatable by a thumb of a user's gripping hand without the user having to remove the same hand from a grip 127 of the firearm and/or without removing a finger of the same hand from a trigger of the firearm.

Figure 3C:
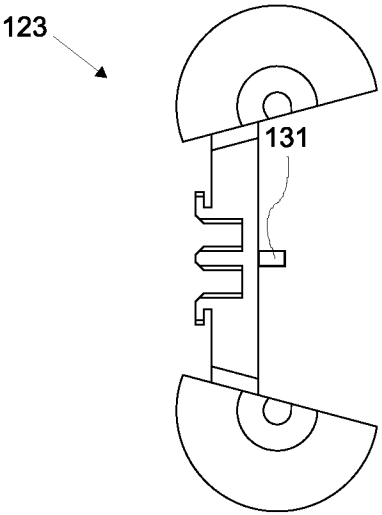
FIG. 3C is a front elevation view of the embodiment of FIG. 3A.
Figure 3A:
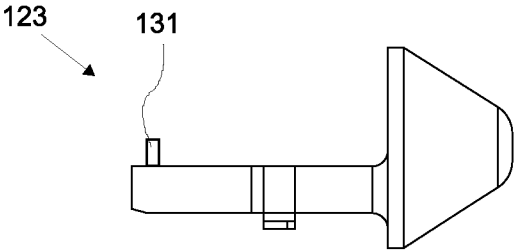
FIG. 3A is a side elevation of an actuator in accordance with this disclosure.
Figure 3B:
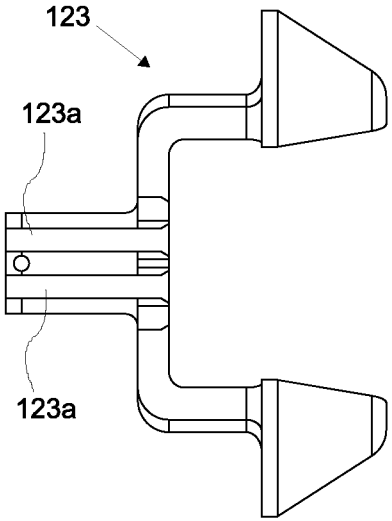
FIG. 3B is a bottom plan view of the embodiment of FIG. 3A.
Figure 4:
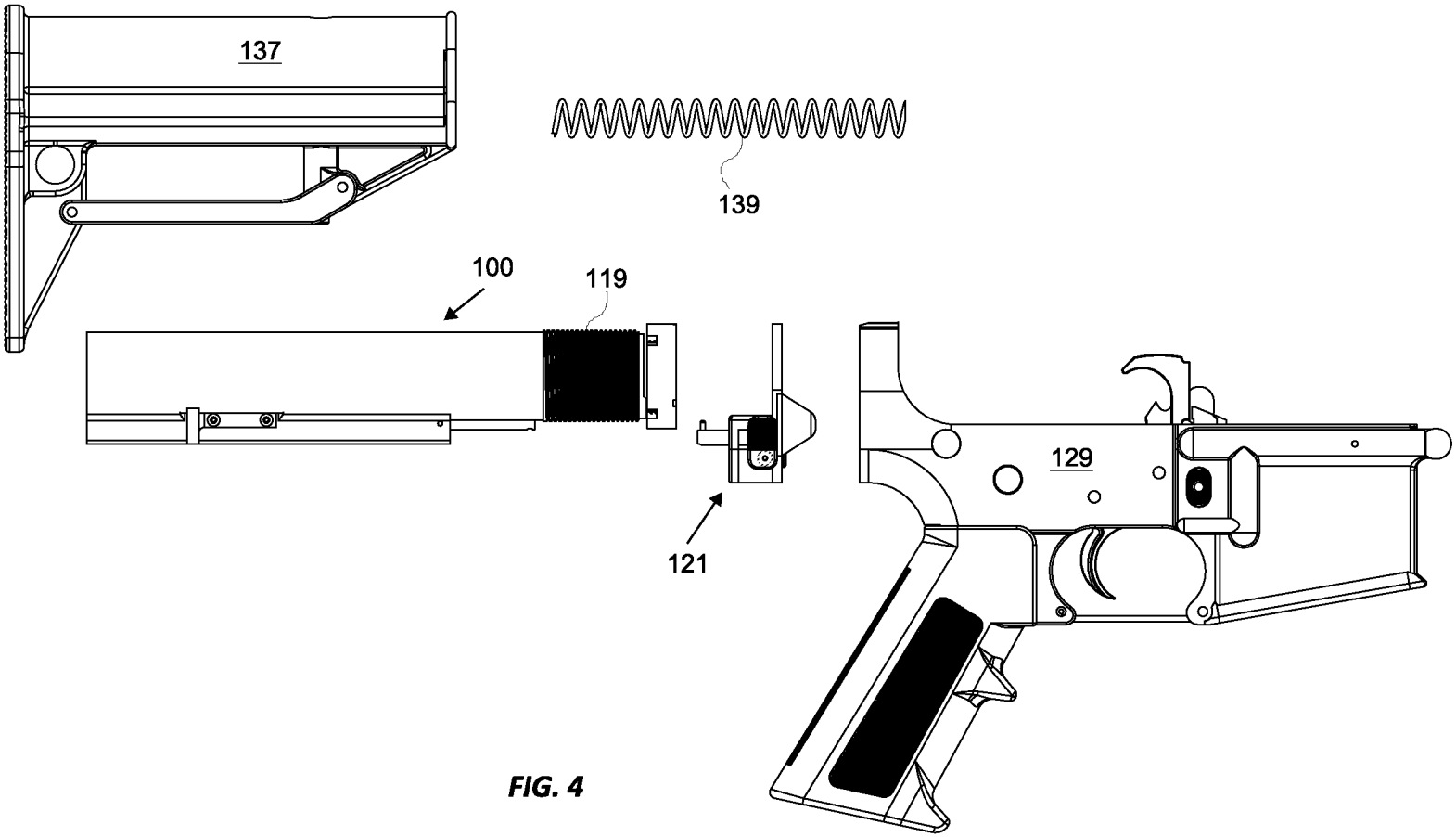
FIG. 4 is an exploded view of the embodiment of FIG. 2A in accordance with this disclosure.

Referring additionally to FIGS. 3A-4, in certain embodiments, the actuator 123 can include one or more blocking member channels 123*a* configured to receive a blocking post 125*a* of the blocking member 125 when the blocking member 125 is in the unblocking position. The actuator 123 can include a U shape and a central portion connected to the U shape, e.g., as shown. Any other suitable shape for the actuator is contemplated herein.

The actuator 123 can include a connector member 131 configured to connect to or connected to the slide bar 111 to allow the slide bar 111 to be pulled by the actuator 123. Any suitable connector member 131 (e.g., a post, a screw, an integral connection with the slide bar 111) is contemplated herein. In certain embodiments, the connector member 131 can be configured to insert into a connector hole in the slide bar 111 when installed on the firearm.

In certain embodiments, the system 200 can include a mounting plate 133 configured to be secured to the firearm by a castle nut 135, e.g., as shown, for example, or any other suitable fastener. The mounting plate 133 can be configured to attach to or is attached to the actuator assembly 121 (e.g., via one or more fasteners as shown in FIG. 2L) to mount the actuator assembly 121 to the firearm. As shown, the actuator assembly 121 can include a housing comprising one or more components configured to house the actuator 123 and/or the blocking member 125 therein. The housing can include one or more fastener holes configured to allow one or more fasteners to mount the housing to the mounting plate 133. Any suitable attachment to attach the actuator assembly 121 to the firearm is contemplated herein.

In certain embodiments, the system 200 can include a stock 137 slideably mountable to or slideably mounted to the buffer tube 100 and configured to move between a collapsed position (e.g., as shown in FIG. 2B) and an extended position (e.g., as shown in FIGS. 2H and 2J). The stock 137 can include any suitable form factor for a firearm stock.

The system 200 can also include a pin 113 disposed in the stock 137 and biased (e.g., with a pin spring as shown) in a direction that is radially inward to the buffer tube 100 such that the pin 113 is biased to a locked position (e.g., as shown in FIGS. 2C, 2E, and 2J) where the pin 113 is inserted into one of the one or more pin holes 107 preventing the stock 137 from sliding relative to the buffer tube 100, and an unlocked position (e.g., as shown in FIGS. 2G and 2H) where the pin 113 is outside of the one or more pin holes 107 and configured to slide with the stock 137 (e.g., in the trough 117) such that the stock 137 is allowed to slide relative to the buffer tube 100. Any suitable number of pins 113 and/or type of pins 113 are contemplated herein.

The system 200 can include one or more stock springs 139 disposed between the buffer tube 100 and the stock 137. The stock springs 139 can be configured to bias the stock 137 to the extended position. Any suitable number of stock springs 139 and/or position thereof (e.g., within the stock 137 and between the stock 137 and one or more stops 141 extending from the rail 105, a single spring within the stock 137 and between the stock 137 and a rear surface of the buffer tube 100).

In accordance with at least one aspect of this disclosure, referring to FIGS. 5-10C, a buffer tube 500 for a firearm (e.g., an AR type platform) can include a body 101 defining an interior cavity 103 for receiving a buffer spring (not shown). The body 101 can be the same as that described above in the embodiment of FIG. 1.

Figure 5:
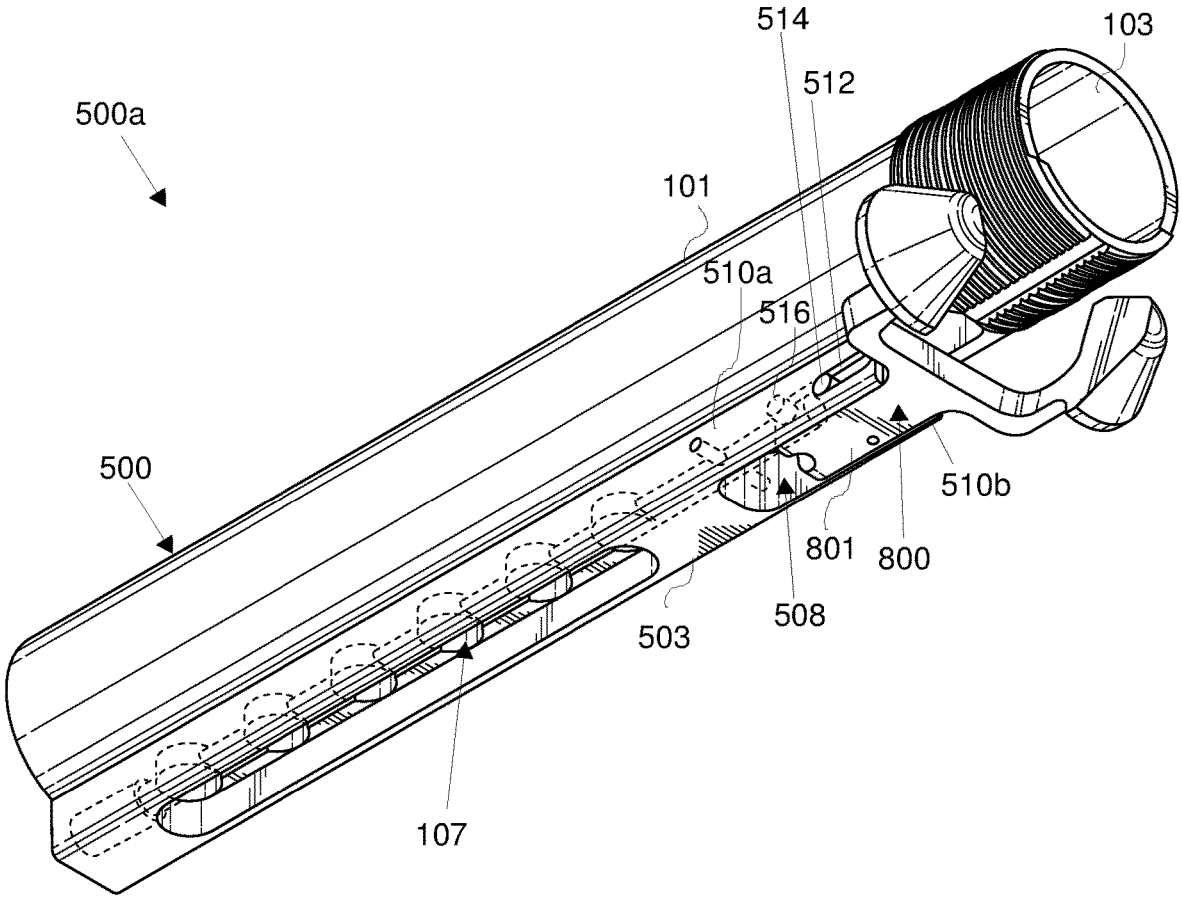
FIG. 5 is a perspective view of an embodiment of a buffer tube assembly in accordance with this disclosure.
Figure 6A:
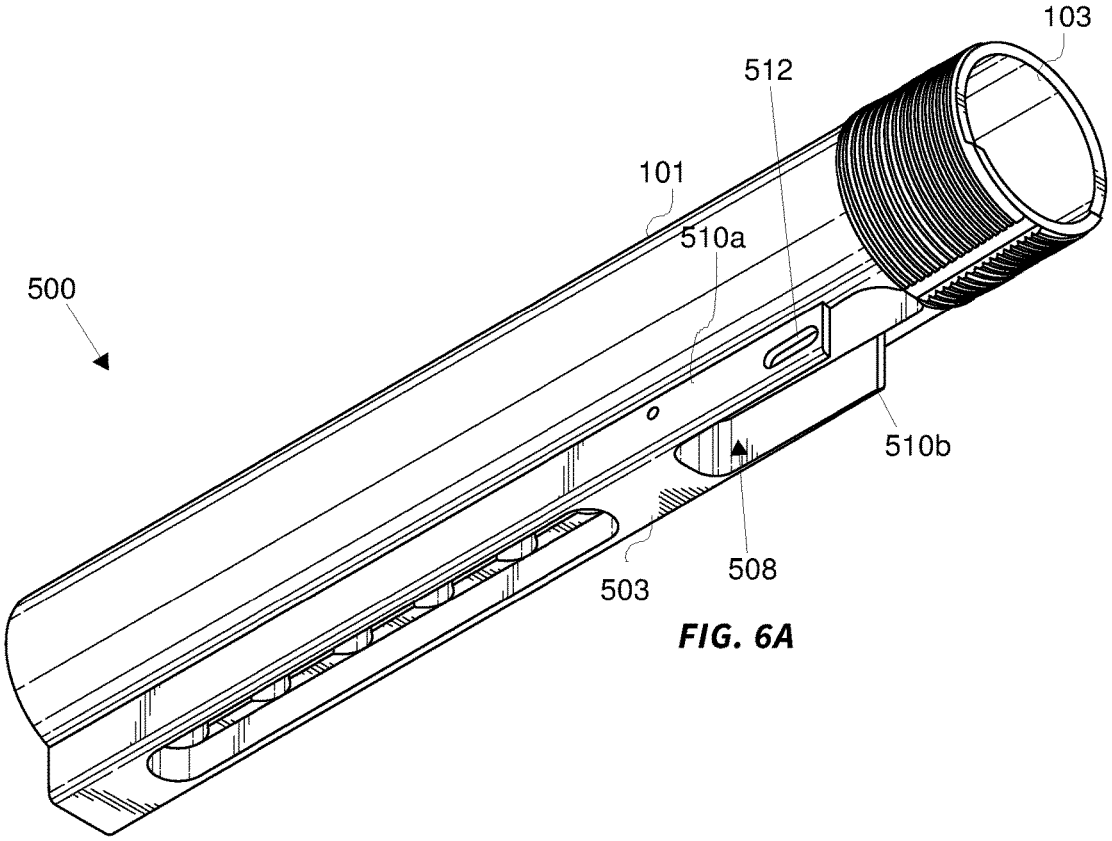
FIG. 6A is a perspective view of an embodiment of a buffer tube in accordance with this disclosure, e.g., as shown used in the assembly of FIG. 5.
Figure 6B:
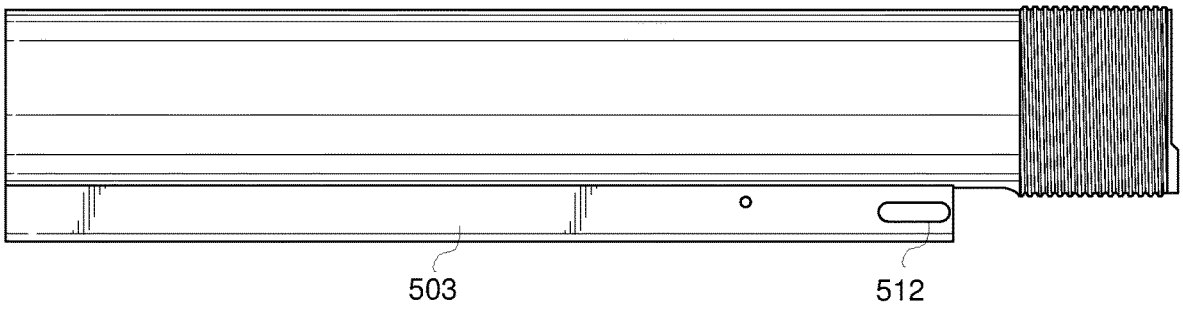
FIG. 6B is a side elevation view of the embodiment of FIG. 6A.
Figure 6C:
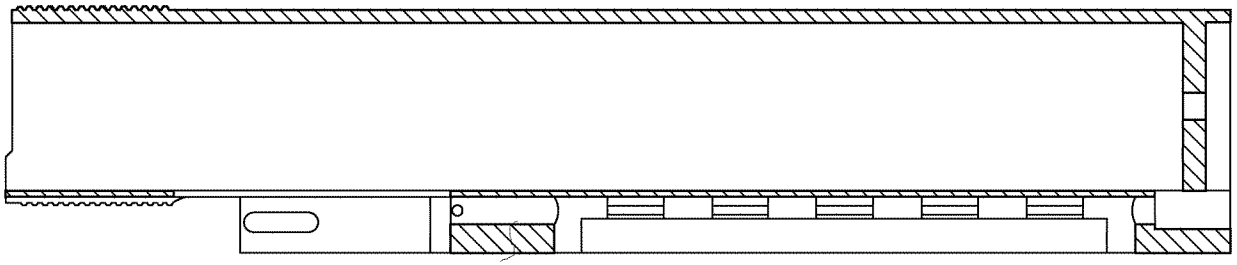
FIG. 6C is a cross-sectional view of the embodiment of FIG. 6B.
Figure 6D:
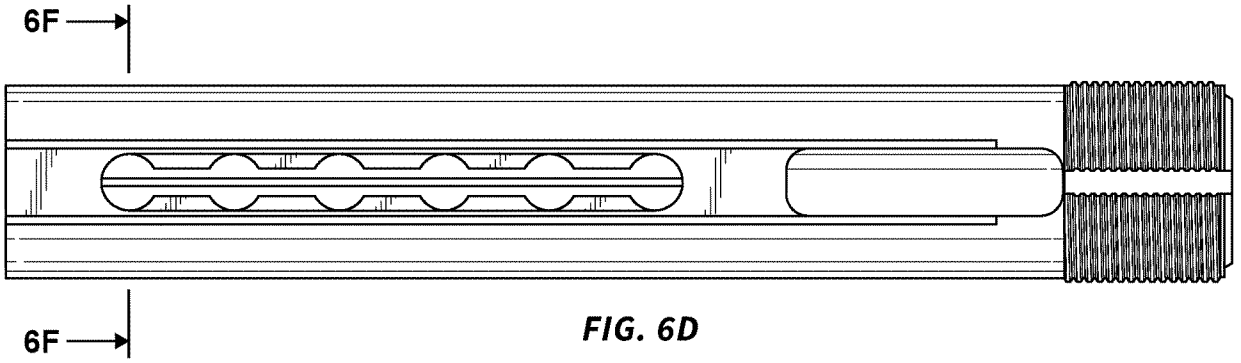
FIG. 6D is a bottom plan view of the embodiment of FIG. 6A.
Figure 6F:
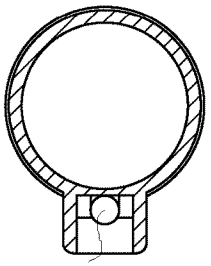
FIG. 6F is a cross-sectional view of the embodiment of FIG. 6E.
Figure 6E:
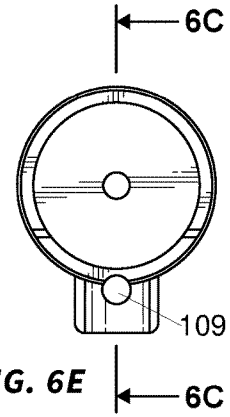
FIG. 6E is a rear view of the embodiment of FIG. 6A.

As shown in FIGS. 5-6F, a buffer tube 500 can include a rail 505 disposed on and/or formed from the outer surface of the body 101. The rail 505 can include one or more pin holes 107 configured to receive a pin of a stock to lock the stock in a position. The rail 503 and/or buffer tube 101 can include any other same or similar features as disclosed above with respect to the embodiment of FIG. 1, for example.

The buffer tube 500 can include a trunk opening 508 defined at an end of the rail 507 forming a first rail sidewall 510*a* and second rail sidewall 510*b* configured to receive a trunk 801 of an actuator 800, e.g., as shown in FIGS. 8A-8D. The first and/or second rail sidewalls 510*a*, 510*b* can include a slot 512 defined therethrough configured to receive a pin 514 associated with the trunk 801 of the actuator 800 to linearly guide the actuator 800 (e.g., forward and backward). In certain embodiments, the slot 512 can be defined through only the first rail sidewall 510*a*, for example, e.g., as shown.

Figure 7A:
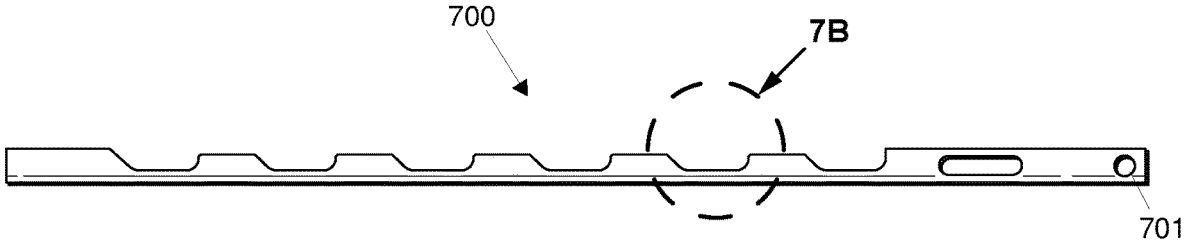
FIG. 7A is a side elevation view of an embodiment of a slide bar in accordance with this disclosure.
Figure 7B:
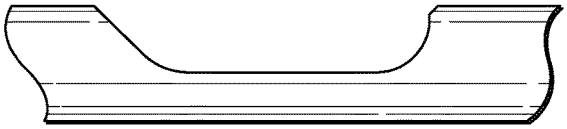
FIG. 7B is a partial side elevation view of the embodiment of FIG. 7A, showing detail of a grove of the slide bar.

The rail 503 can include a slide bar channel 109 defined through at least a portion of the rail 503 and configured to allow a slide bar 700 (e.g., as shown in FIGS. 7A and 7B) to slide therein relative to the one or more pin holes 107 to urge a pin out of a respective pin hole and/or to block a pin from being received by the pin holes 107. The buffer tube 500 can be configured to attach to an AR platform rifle (e.g., an AR 15, using a threaded end and a castle nut) and/or any other suitable firearm having a buffer tube.

In accordance with at least one aspect of this disclosure, a buffer tube assembly 500*a* can include a buffer tube 500 for a firearm, e.g., as disclosed above. The assembly 500*a* can include a slide bar 700 disposed in the slide bar channel 109 to slide therein relative to the one or more pin holes 107 to urge a pin out of a respective pin hole and/or to block a pin from being received by the pin holes 107 in an actuated position (moved forward), and to allow a pin to enter the one or more pin holes 107 in an unactuated position (in a rear position, e.g., as shown in FIG. 5). The assembly 500*a* can include an actuator 800 connected to the slide bar 700 to pull the slide bar 700. The actuator 800 can include a trunk 801 slidably disposed within the trunk opening 508 in the rail 507 between the first and second rail sidewalls 510*a, b*. The actuator 800 can include a slide pin 514 extending laterally from the trunk 508 of the actuator 800 and configured to be inserted into the slot 512 to engage the slot 512 to linearly guide the actuator 800.

In certain embodiments, the slide pin 514 can extend from a single side of the trunk 508, for example as shown (e.g., where the slot 512 is only on one of the sidewalls 510*a*, 510*b*). However, it is contemplated that the second rail sidewall 510*b* can also include a slot (e.g., similar to slot 512) and the actuator 800 can include one or more pins 514 that extend into both slots.

In certain embodiments, the actuator 800 can be pinned to the slide bar 700 (e.g., via a pin 516 attached to pin hole 701) and configured to rotate relative to the slide bar 700 when the slide pin 514 is disengaged from the slot 512.

Figure 8A:
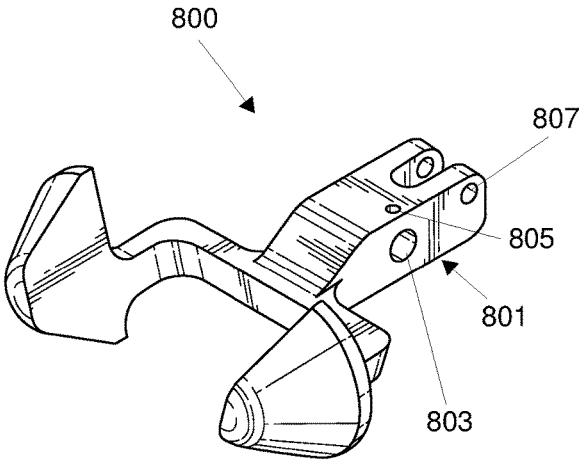
FIG. 8A is a perspective view of an embodiment of an actuator in accordance with this disclosure.
Figure 8B:
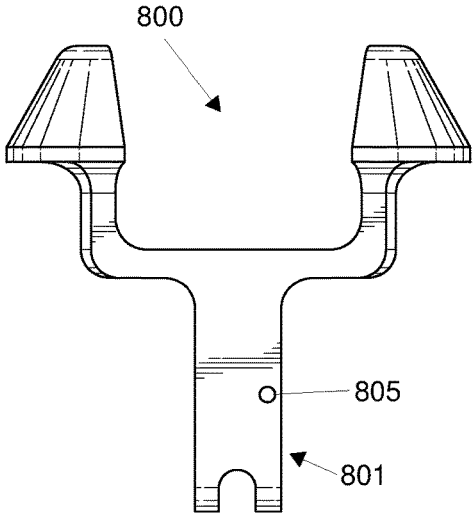
FIG. 8B is a plan view of the embodiment of FIG. 8A.
Figure 8C:
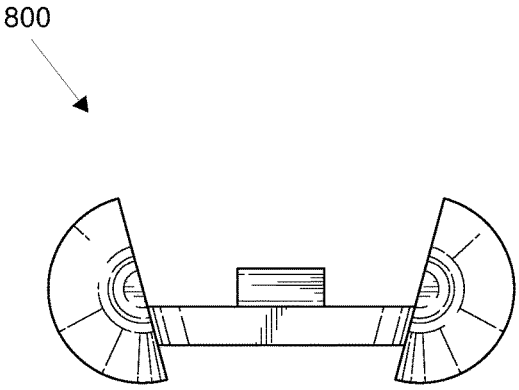
FIG. 8C is a front elevation view of the embodiment of FIG. 8A.
Figure 8D:
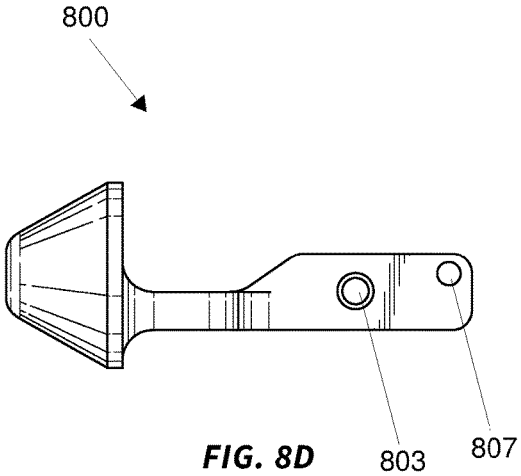
FIG. 8D is a side elevation view of the embodiment of FIG. 8A.
Figure 9A:
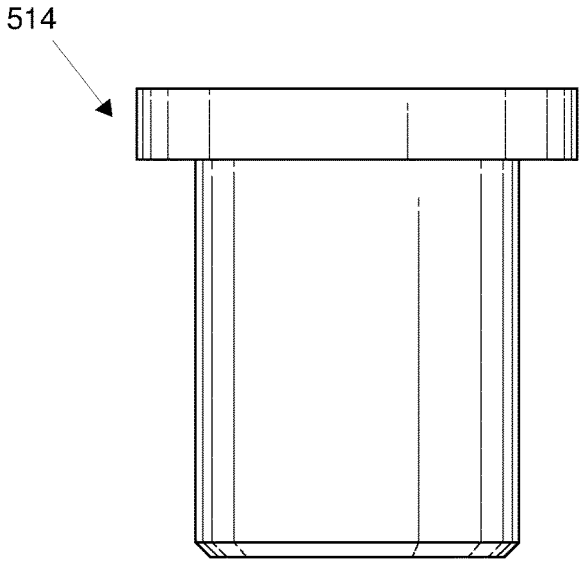
FIG. 9A is a plan view of an embodiment of a pin in accordance with this disclosure.
Figure 9B:
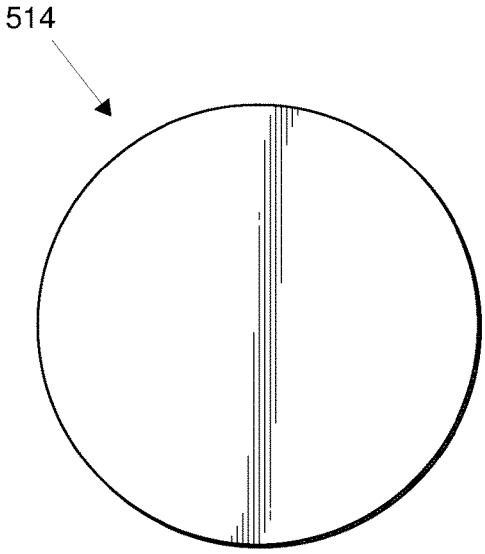
FIG. 9B is an elevation view of the embodiment of FIG. 9A.
Figure 9C:
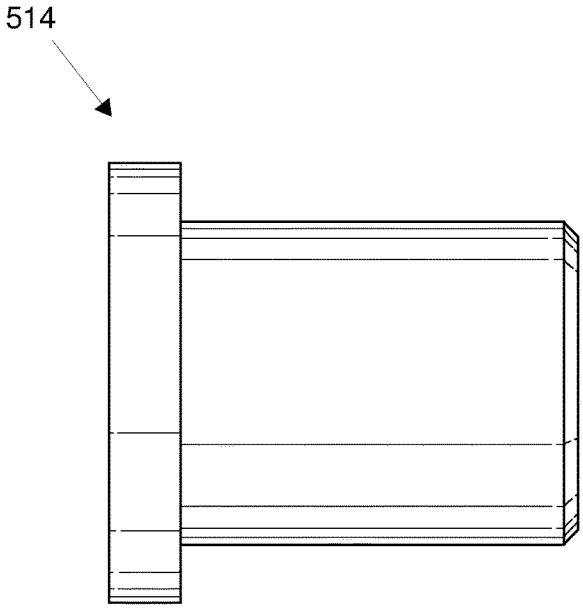
FIG. 9C is a side elevation view of the embodiment of FIG. 9A.

In certain embodiments, the slide pin 514 can be biased to extend laterally outward to engage the slot 512. For example, the slide pin 514 can be depressible to allow the slide pin 514 to be removed from the slot 512 for removal of the actuator 800 from the rail 503. As shown in FIGS. 8A and 8D, the actuator 800 can include a pin hole 803 where the pin 514 mounts. The pin 514 can be locked into the pin hole 803 with a spring behind the pin 514 to bias the pin 514 outward and be limited to sliding motion in and out. The pin 514 can be blocked from exiting the pin hole 803 using a radial fastener (e.g., threaded into a radial hole 807 relative to the pin hole 803. As shown in FIGS. 9A-9C, the pin 514 can include a feature (e.g., a flange) that is blocked by the radial fastener 805.

The actuator 800 can be pinned to the slide bar 700 and configured to rotate relative to the slide bar 700 when the slide pin 514 is disengaged from the slot 512, and to pull the slide bar 700 (e.g., forward). For example, a pin 516 can be disposed through the trunk pin hole 807, and through the slide bar pin hole 701. The slide bar 700 can be nested between rear prongs of the actuator 800 where the trunk pin hole 807 is located.

Figure 10A:
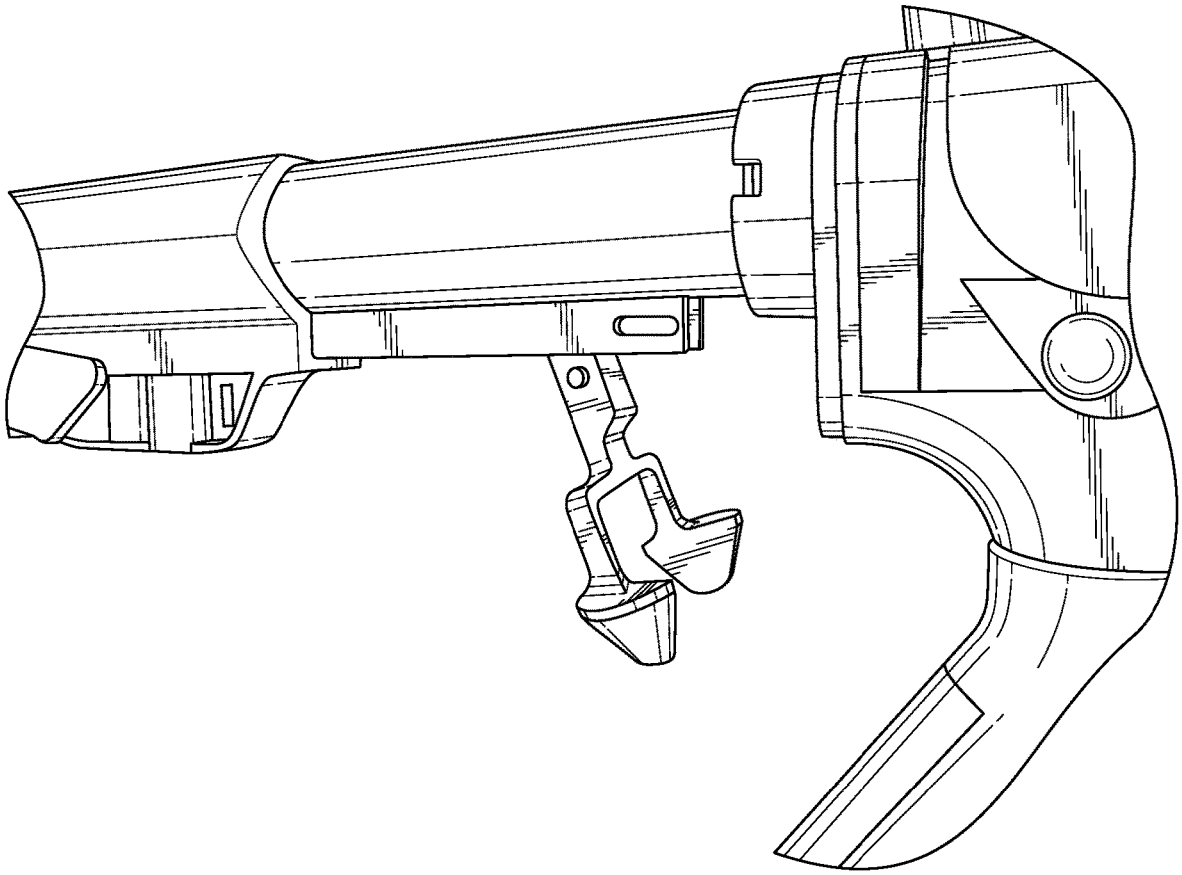
FIG. 10A is a perspective view showing the buffer tube assembly of FIG. 5 attached to a firearm, wherein the actuator is in a disengaged and folded position (e.g., which can allow installation and removal of the assembly)
Figure 10B:
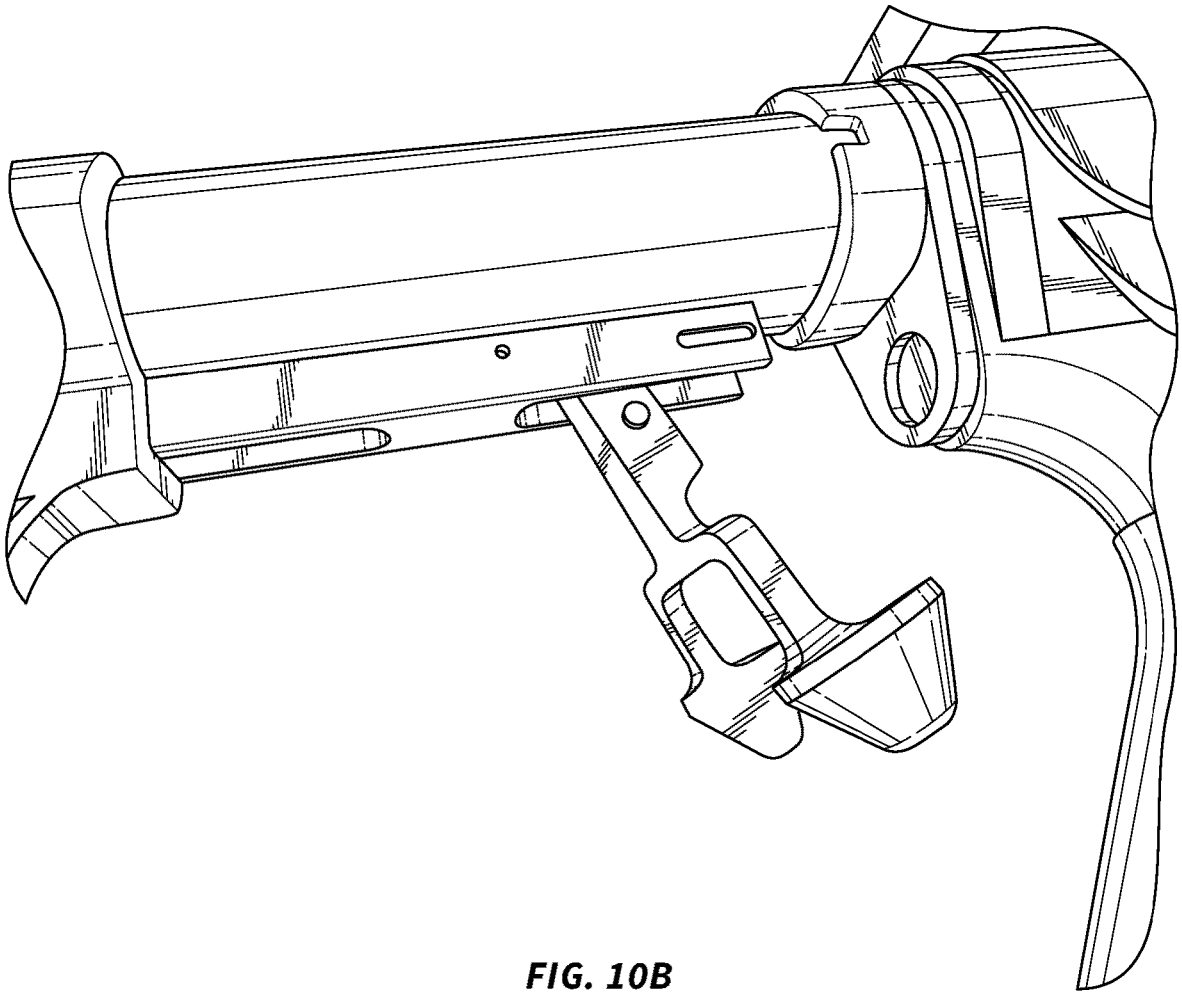
FIG. 10B is another perspective view of the embodiment of FIG. 10A.
Figure 10C:
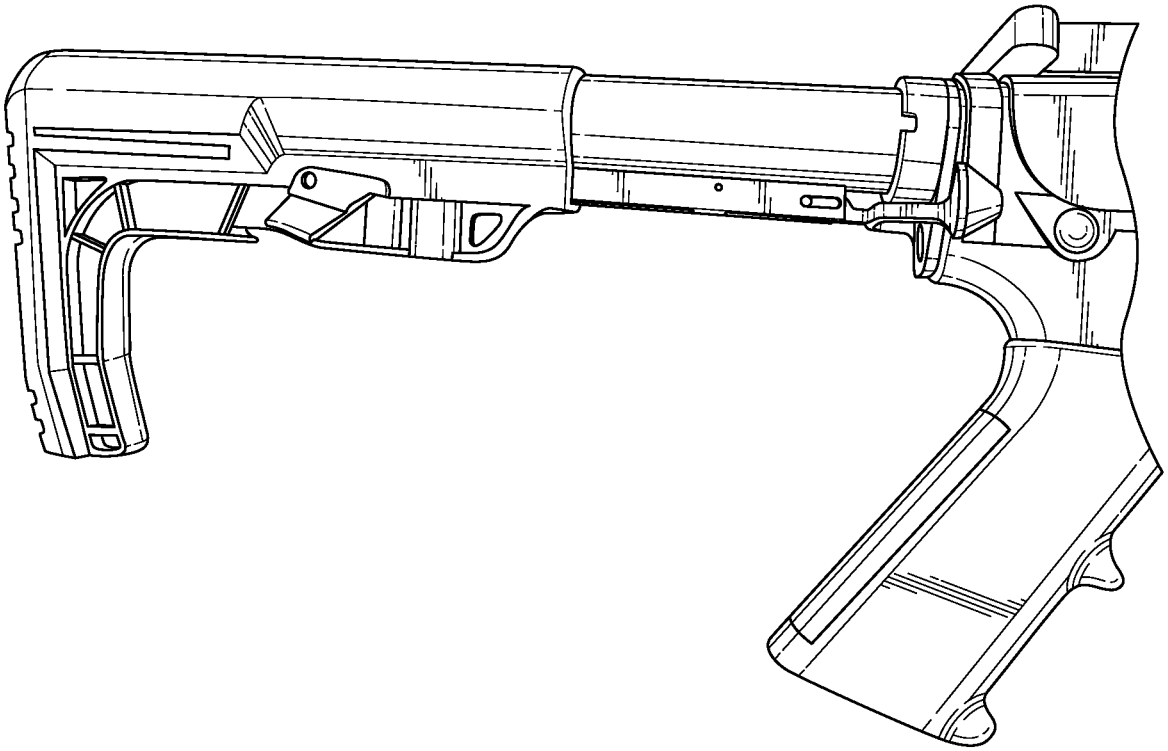
FIG. 10C is a side elevation view of the embodiment of FIG. 10A, shown with the actuator hinged up into the engaged position in accordance with this disclosure.

In certain embodiments, in an engaged position where the pin 514 is engaged in the slot 512 (e.g., as shown in FIGS. 5 and FIG. 10C), the actuator 800 can extend underneath a connection end of the body 101 (e.g., to a position that is reachable by a thumb of a user without removing a user's hand from a firing position, e.g., under a threaded portion of the body 101) and can be configured to be linearly actuated (e.g., by a user's thumb of their firing hand without removing the hand from a grip). The actuator 800 can include one or more branches extending from the trunk 801 that can include a thumb tab to be actuated by a thumb. As shown, certain embodiments can be ambidextrous and include a thumb tab on both sides of the trunk 801.

In a disengaged and folded position, e.g., as shown in FIGS. 10A and 10B, the actuator 800 can extend further rearward to be further away from the connection end (e.g., the threaded end as shown) of the body 101 to aid installation of the body 101 onto a firearm (e.g., using a castle nut). For example, in the disengaged and folded position, the actuator 800 can extend away (e.g., downward) from the body 101 and the connection end of the body 101 as shown.

The assembly 500*a* can include a biasing member (e.g., slid bar biasing member 115) configured to bias the slide bar 700 and/or the actuator 800 to the unactuated position. In certain embodiments, the biasing member can be disposed at a rear end of the slide bar 700 (e.g., as shown in FIGS. 1G and 1L with respect to slide bar 111). The biasing member can be trapped between a fastener (e.g., as screw) attached to a rear of slide bar 700 and an inner surface of the rail 503 such that when the slide bar 700 is actuated toward the actuated position (e.g., pulled forward by the actuator 800), the biasing member 115 is compressed between the fastener and the inner surface of the rail 503 (e.g., similar as shown in the embodiment of FIG. 1L).

In certain embodiments, the actuator 800 can be attached to a front end of the slide bar 700 as shown. In certain embodiments, the slide bar 700 can be confined to linear sliding motion within the rail 503.

In accordance with at least one aspect of this disclosure, a method can include attaching a connection end of a body of a buffer tube assembly onto a firearm, and folding an actuator attached to the buffer tube assembly to engage a pin of the actuator to a rail to constrain the motion of the actuator to be linear, and preventing removal of the connection end due to a position of the actuator. The method can include disengaging the pin of the actuator, and folding the actuator away from the body of the buffer tube to allow installation or removal of the buffer tube assembly.

FIGS. 5-10C show another embodiment of a buffer tube and actuator assembly, e.g., as shown in FIG. 5. While similar to the embodiment of FIGS. 1A-4, this embodiment can include a different actuator (e.g., as shown in FIGS. 8A-8C) mounted to the slide bar (e.g., as shown in FIGS. 7A and 7B) and buffer tube (as shown in FIGS. 6A-6E) in a different manner. A trunk of the actuator can fit within a trunk opening in the rail of the buffer tube. The buffer tube rail can include at least one slot defined therein (where the trunk opening is), e.g., as shown in FIG. 6A, for receiving a pin extending from the trunk of the actuator. The actuator can include a slide pin extending laterally from the actuator and configured to mate with the slot defined on the buffer tube rail, e.g., as shown mated in FIG. 5. The slide pin can be only extending from a single side, however, it is contemplated that one or more slide pins can be used that extend from either or both sides of the actuator. The slide pin can also be removable or depressible (with an internal spring assembly in the actuator) to allow the slide pin to be removed from the slot for removal of the actuator from the rail.

As shown, the actuator can be laterally pinned to the slide bar to connect to the slide bar. Such a connection allows the actuator to be rotated downward away from the buffer tube if the slide pin is not engaged to the slot in the buffer tube rail. This ability to rotate downward can aid in installation and removal of the buffer tube.

The embodiment of FIGS. 5-10C also does not include any side spring stops. In such an embodiment, the biasing member that biases the stock to the extended position can be placed between the buttstock and the back of the buffer tube. However, any suitable assembly is contemplated herein. Any suitable components and/or portions of the different embodiments can be combined or swapped out as appreciated by those having ordinary skill in the art.

Also different from the embodiment of FIGS. 1A-4, the actuator can be simplified into a single piece device without having other components needed for installation onto the lower or buffer tube. For example, no safety lock mechanism for the actuator is included in the embodiment of FIGS. 5-10C. Embodiments can be installed without additional components to a traditional buffer tube, allowing easy retrofitting.

Buffer tubes can include a cylindrical tube portion and a lower rectangular portion consisting of a multitude of linear holes. These holes can be designed to catch a plunger from a collapsible rifle stock. The stock can have a lower lever that when actuated, pulls the stock plunger from the occupied hole and the stock can then be manually moved by the rifleman to another of the holed positions by moving one of his hands from the rifle.

Embodiments can include an interior spring, which can be compressed by the rifle bolt upon cycling of the action. Embodiments can include a multitude of linear holes/teeth for the spring loaded collapsible plunger to engage. The canal can be cut on the bottom of the rectangular box which runs from the front to the rear and cuts directly through the multitude of linear holes/teeth. In that canal, a pull bar can be placed which has angled teeth, and those teeth can be located in a position that each tooth can be behind each linear hole.

The angle of each tooth can start from the bottom of the hole and can rise at an angle which can lift the stock plunger out of the hole. The front of the pull bar can have two levels, parallel to each other. The higher level can have a spring (e.g., a pull bar return spring) located between its front and the front of the rectangular box.

The lower level of the pull bar can have four, or any other suitable number, of screw holes allowing the attachment of a forward moving actuator. The actuator placed on either or both sides of the rifle grip can be positioned that it can be pushed forward from the firing hand while the rifleman can still hold the grip or fire the weapon if needed during actuator deployment.

The actuator (on either, or both sides) of the rifle can also have a sliding component which can require the rifleman to first push the (spring loaded) slider from the middle of the rear end plate located beneath the castle nut, in an outward direction, away from the center of the rear of the rifle. When the slider is moved perpendicular to the rifle, it can allow the forward pushing movement on the actuator(s) which then can pull the pull bar (located in the canal of the lower rectangular box lower buffer tube) in a forward motion.

As the pull bar moves forward, the multitude of teeth can simultaneously move from the solid portions of the buffer tube located between each stock plunger hole, into the hole. Whichever hole contains the plunger from the stock is then engaged from its bottom and the stock plunger is driven up out of the hole with the progression of the forward actuation. When the stock plunger is lifted entirely out of the hole/tooth, the stock then springs backward either to any of the further back holes/teeth (if controlled by the rifleman's shoulder or all the way back to the rear hole/tooth where a secondary stop spot eliminates the possibility of the stock to come off of the buffer tube.

The spring action pushing the stock to the rear can be from a spring positioned between the rear of the buffer tube and the front of the rifle stock's butt plate, for example. When the forward moving actuator is released, the spring at the front of the pull bar can cause the forward moving actuator to move rearward to its initial position, the pull bar can return to its rearward initial position (placing the teeth into the solid locations located between the plunger holes/teeth), and the perpendicular slider(s) located on the actuators can return to their initial position behind the rear end plate.

Embodiments of a buffer tube release the moving portion of the stock freely to multiple positions while the rifleman can keep both of his hands on the weapon for potential engagements.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A buffer tube for a firearm, comprising:

a body defining:

an interior cavity for receiving a buffer spring; and a rail disposed on and/or formed from the outer surface of the body, the rail comprising:

one or more pin holes configured to receive a pin of a stock to lock the stock in a position;

a trunk opening defined at an end of the rail forming a first rail sidewall and second rail sidewall configured to receive a trunk of an actuator, wherein the first rail sidewall and/or second rail sidewall includes a slot defined therethrough configured to receive a pin associated with the trunk of the actuator to linearly guide the actuator; and a slide bar channel defined through at least a portion of the rail and configured to allow a slide bar to slide therein relative to the one or more pin holes to urge a pin out of a respective pin hole and/or to block a pin from being received by the pin holes.

2. A buffer tube assembly, comprising:

a buffer tube for a firearm, comprising:

a body defining:

an interior cavity for receiving a buffer spring; and a rail disposed on and/or formed from the outer surface of the body, the rail comprising:

one or more pin holes configured to receive a pin of a stock to lock the stock in a position;

a trunk opening defined at an end of the rail forming a first rail sidewall and second rail sidewall, wherein the first and/or second rail sidewall includes a slot defined therethrough; and a slide bar channel defined through at least a portion of the rail;

a slide bar disposed in the slide bar channel to slide therein relative to the one or more pin holes to urge a pin out of a respective pin hole and/or to block a pin from being received by the pin holes in an actuated position, and to allow a pin to enter the one or more pin holes in an unactuated position; and an actuator connected to the slide bar to pull the slide bar, comprising:

a trunk slidably disposed within the trunk opening in the rail between the first and second rail sidewalls; and a slide pin extending laterally from the trunk of the actuator and configured to be inserted into the slot to engage the slot to linearly guide the actuator.

3. The assembly of claim 2, wherein the slide pin extends from a single side of the trunk.

4. The assembly of claim 2, wherein the actuator is pinned to the slide bar and configured to rotate relative to the slide bar when the slide pin is disengaged from the slot.

5. The assembly of claim 2, wherein the slide pin is biased to extend laterally outward to engage the slot, and wherein the slide pin is depressible to allow the slide pin to be removed from the slot for removal of the actuator from the rail.

6. The assembly of claim 5, wherein the actuator is pinned to the slide bar and configured to rotate relative to the slide bar when the slide pin is disengaged from the slot, and to pull the slide bar.

7. The assembly of the claim 6, wherein in an engaged position where the pin is engaged in the slot, the actuator extends underneath a connection end of the body and is configured to be linearly actuated, and in a disengaged and folded position, the actuator extends further rearward to be further away from the connection end of the body to aid installation of the body onto a firearm.

8. The assembly of claim 7, wherein in the disengaged and folded position, the actuator extends away from the body and the connection end of the body.

9. The assembly of claim 2, further comprising a biasing member configured to bias the slide bar and/or the actuator to the unactuated position.

10. The assembly of claim 9, wherein the biasing member is disposed at a rear end of the slide bar.

11. The assembly of claim 10, wherein the biasing member is trapped between a fastener attached to a rear of slide bar and an inner surface of the rail such that when the slide bar is actuated toward the actuated position, the biasing member is compressed between the fastener and the inner surface of the rail.

12. The assembly of claim 11, wherein the actuator is attached to a front end of the slide bar.

13. The assembly of claim 12, wherein the slide bar is confined to linear sliding motion within the rail.

14. A method, comprising:

attaching a connection end of a body of a buffer tube assembly onto a firearm;

folding an actuator attached to the buffer tube assembly to engage a pin of the actuator to a rail to constrain the motion of the actuator to be linear, and preventing removal of the connection end due to a position of the actuator.

15. The method of claim 14, further comprising disengaging the pin of the actuator, and folding the actuator away from the body of the buffer tube to allow installation or removal of the buffer tube assembly.

* * * * *